US011737950B2

(12) United States Patent
Mills et al.

(10) Patent No.: US 11,737,950 B2
(45) Date of Patent: Aug. 29, 2023

(54) MASSAGE GUN MOUNTING SYSTEM AND DEVICE FOR USE IN REHABILITATION AND GYM SETTINGS

(71) Applicant: WELLX FITNESS LLC, Aspen, CO (US)

(72) Inventors: David R. Mills, Aspen, CO (US); Bradley F. Abbott, Crowley, TX (US)

(73) Assignee: WELLX FITNESS LLC, Aspen, CO (US)

( * ) Notice: Subject to any disclaimer, the term of this patent is extended or adjusted under 35 U.S.C. 154(b) by 0 days.

(21) Appl. No.: 17/882,893

(22) Filed: Aug. 8, 2022

(65) Prior Publication Data

US 2023/0055917 A1 Feb. 23, 2023

Related U.S. Application Data

(60) Provisional application No. 63/330,107, filed on Apr. 12, 2022, provisional application No. 63/257,382, filed on Oct. 19, 2021, provisional application No. 63/234,542, filed on Aug. 18, 2021.

(51) Int. Cl.
*A61H 23/00* (2006.01)
*B25B 5/10* (2006.01)

(52) U.S. Cl.
CPC ..... *A61H 23/006* (2013.01); *B25B 5/102* (2013.01); *A61H 2201/0107* (2013.01); *A61H 2201/0134* (2013.01); *A61H 2201/0192* (2013.01)

(58) Field of Classification Search
CPC ..... A61H 23/006; A61H 2201/0107; A61H 2201/0134; A61H 2201/0192; A61H 1/00; A61H 2201/0119; A61H 2201/0123; A61H 2201/0126; A61H 2201/1611; A61H 2201/1626; A61H 23/00; A61H 23/02; B25B 5/102; F16M 13/02; F16M 13/022
See application file for complete search history.

(56) References Cited

U.S. PATENT DOCUMENTS

| | | | |
|---|---|---|---|
| 5,018,511 | A | 5/1991 | Yokoi |
| 5,848,980 | A | 12/1998 | Demerais |
| 6,543,637 | B1 | 4/2003 | Osborn |
| 7,025,736 | B1 | 4/2006 | Lawrence |
| 7,175,143 | B1 | 2/2007 | Ho |
| 10,251,807 | B2 | 4/2019 | Marson |
| 2005/0137505 | A1 | 6/2005 | Munday |
| 2006/0074360 | A1 | 4/2006 | Yu |
| 2007/0276301 | A1 | 11/2007 | Schefthaler |
| 2008/0255486 | A1 | 10/2008 | Ludlow |
| 2016/0008213 | A1 | 1/2016 | Cheng |

OTHER PUBLICATIONS

Amazon, The Gun Grip Hands Free Massage Gun System, Amazon website, retrieved May 19, 2021, 7 pages, https://www.amazon.com/thegungripdp/B095DRWWG8?ref=myi_title_dp, Amazon Online, Seattle, WA US.

*Primary Examiner* — Quang D Thanh
(74) *Attorney, Agent, or Firm* — Olav M. Underdal; IDP Patent Services

(57) ABSTRACT

A massage gun mounting system, includes a massage gun mounting device, including a structure connector with right and left clamp portions; and a massage gun holder with right and left holder portions, such that the structure connector connects to a mounting structure; such that a handle of a massage gun device is insertable into the massage gun holder, such that a user is enabled to apply pressure to a massage delivery member of the mounted massage gun device.

29 Claims, 26 Drawing Sheets

Massage Gun Mounting System

Massage Gun Mounting System

Massage Gun Mounting Device

Massage Gun Mounting Device

Massage Gun Mounting System

Massage Gun Mounting System

Massage Gun Mounting System

MASSAGE GUN MOUNTING SYSTEM AND DEVICE FOR USE IN REHABILITATION AND GYM SETTINGS

CROSS-REFERENCE TO RELATED APPLICATIONS

This U.S. Non-Provisional Application claims the benefit of U.S. Provisional Application No. 63/330,107, filed Apr. 12, 2022; and claims the benefit of U.S. Provisional Application No. 63/257,382, filed Oct. 19, 2021; and claims the benefit of U.S. Provisional Application No. 63/234,542, filed Aug. 18, 2021; all three of which are hereby incorporated herein by reference in their entirety.

FIELD OF THE INVENTION

The present invention relates generally to the field of exercise equipment for personal use, and more particularly to methods and systems for mounting a massage gun for the purpose of single user usage.

BACKGROUND OF THE INVENTION

Consumers will frequently use a massage gun device to massage their back and body following workouts or for rehabilitation purposes.

However, such devices often require a secondary individual to position and hold the device for massaging purposes. While some back-massager devices are available with pre-affixed mounts, there are generally no available options for mounts that can hold a generic massage gun.

As such, considering the foregoing, it may be appreciated that there continues to be a need for novel and improved devices and methods for mounting a massage gun onto a mounting structure.

SUMMARY OF THE INVENTION

The foregoing needs are met, to a great extent, by the present invention, wherein in aspects of this invention, enhancements are provided to the existing model of massage gun mounting systems.

In an aspect, a massage gun mounting system can include:

a) a massage gun mounting device, which can include:
  - a structure connector, which securely and detachably attaches the massage gun mounting device to a mounting structure and can be adjusted to a thickness of the mounting structure; and
  - a massage gun holder, which is connected to the structure connector; and b) a massage gun device, which can include:
  - a handle member; and
  - a massage delivery member; and wherein the massage gun holder is configured to receive the handle member, such that the handle member is insertable into the massage gun holder, such that the massage gun holder is configured to hold the handle member securely, whereby the massage gun mounting device holds the massage gun device securely;

whereby the massage gun device is stably and safely positionable in a convenient position on the mounting structure, such that the user is enabled to apply pressure to a body area of the user with the massage delivery member of the massage gun device.

In a related aspect, the structure connector can further include:

a) a left clamp portion; and b) a right clamp portion, which is connected to the left clamp portion;

wherein the structure connector can be configured to enable adjustment of a lateral gap between the left clamp portion and the right clamp portion, to match a thickness of the mounting structure.

In another related aspect, the massage gun holder can further include:

a) a left holder portion, which is configured to hold a left side of the handle member of the massage gun device; and b) a right holder portion, which is configured to hold a right side of the handle member of the massage gun device;

wherein the left holder portion is flexibly connected to the right holder portion along a vertical length of rear ends of the left holder portion and the right holder portion.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
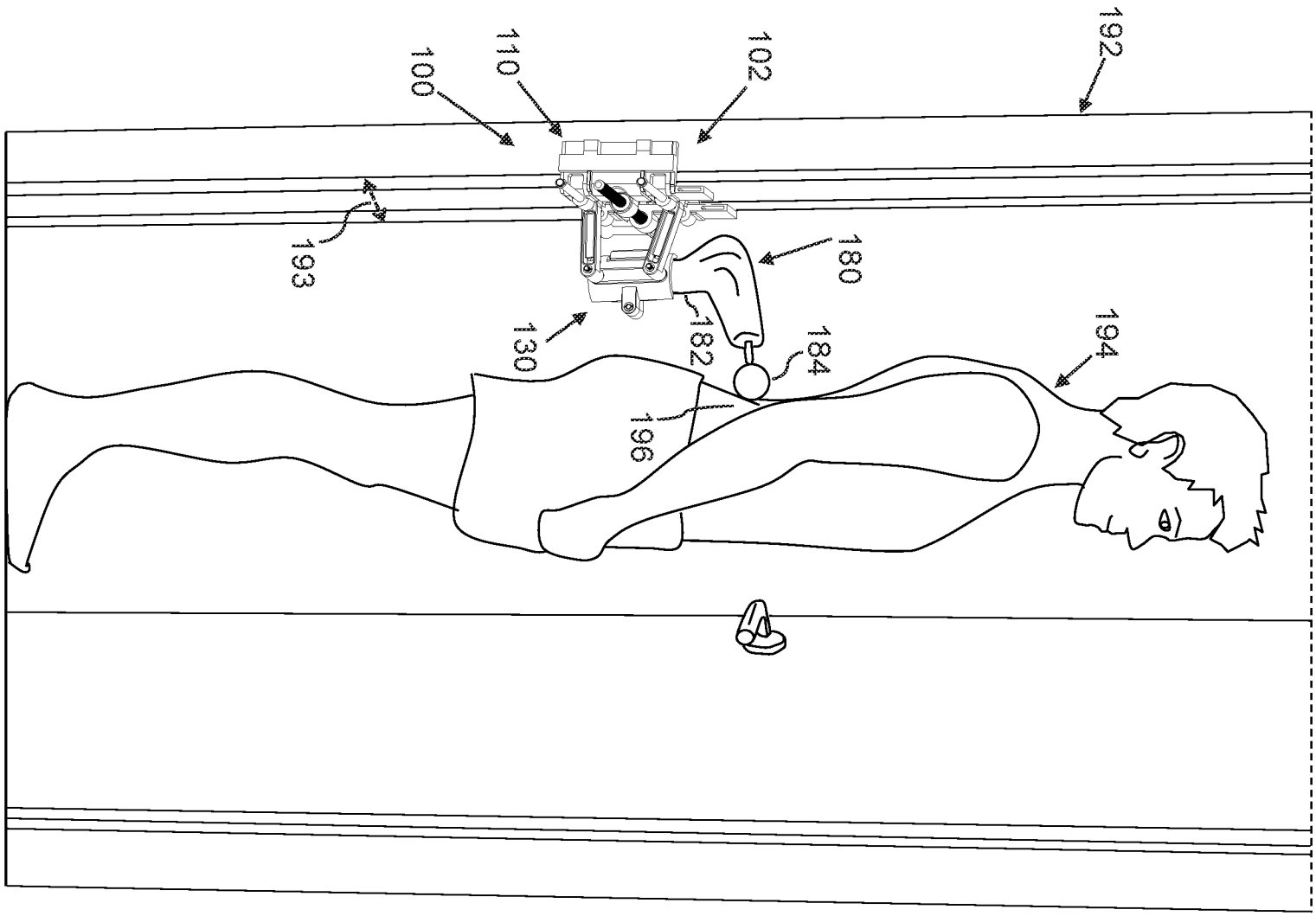
FIG. 1 is a schematic diagram illustrating a massage gun mounting device system in use, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a massage gun mounting system 100 and massage gun mounting device 102, with reference to FIG. 1, in such manner that like reference numerals refer to like components throughout; a convention that we shall employ for the remainder of this specification.

Figure 2A:
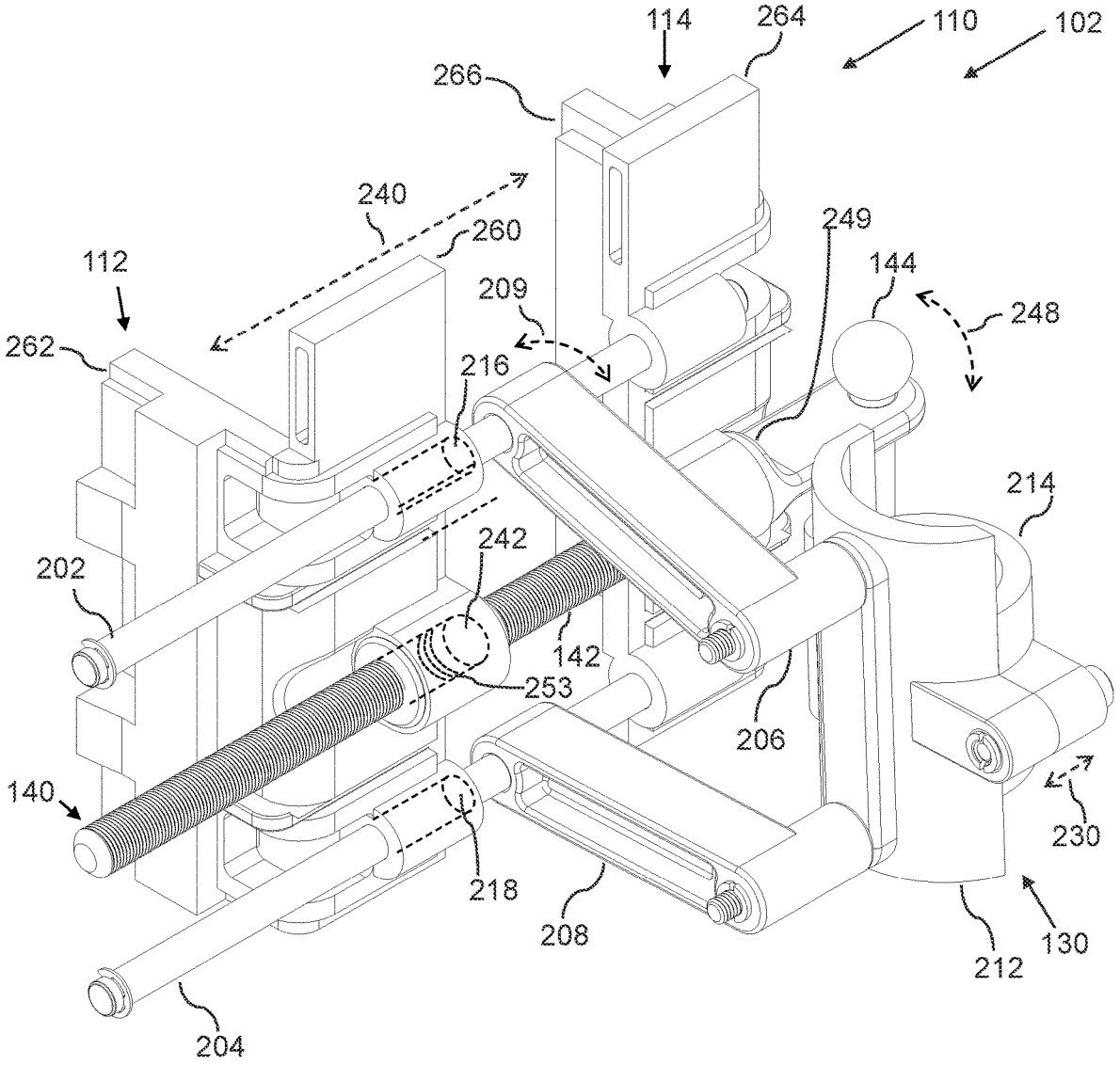
FIG. 2A is a top left perspective view of a massage gun mounting device, according to an embodiment of the invention.
Figure 2B:
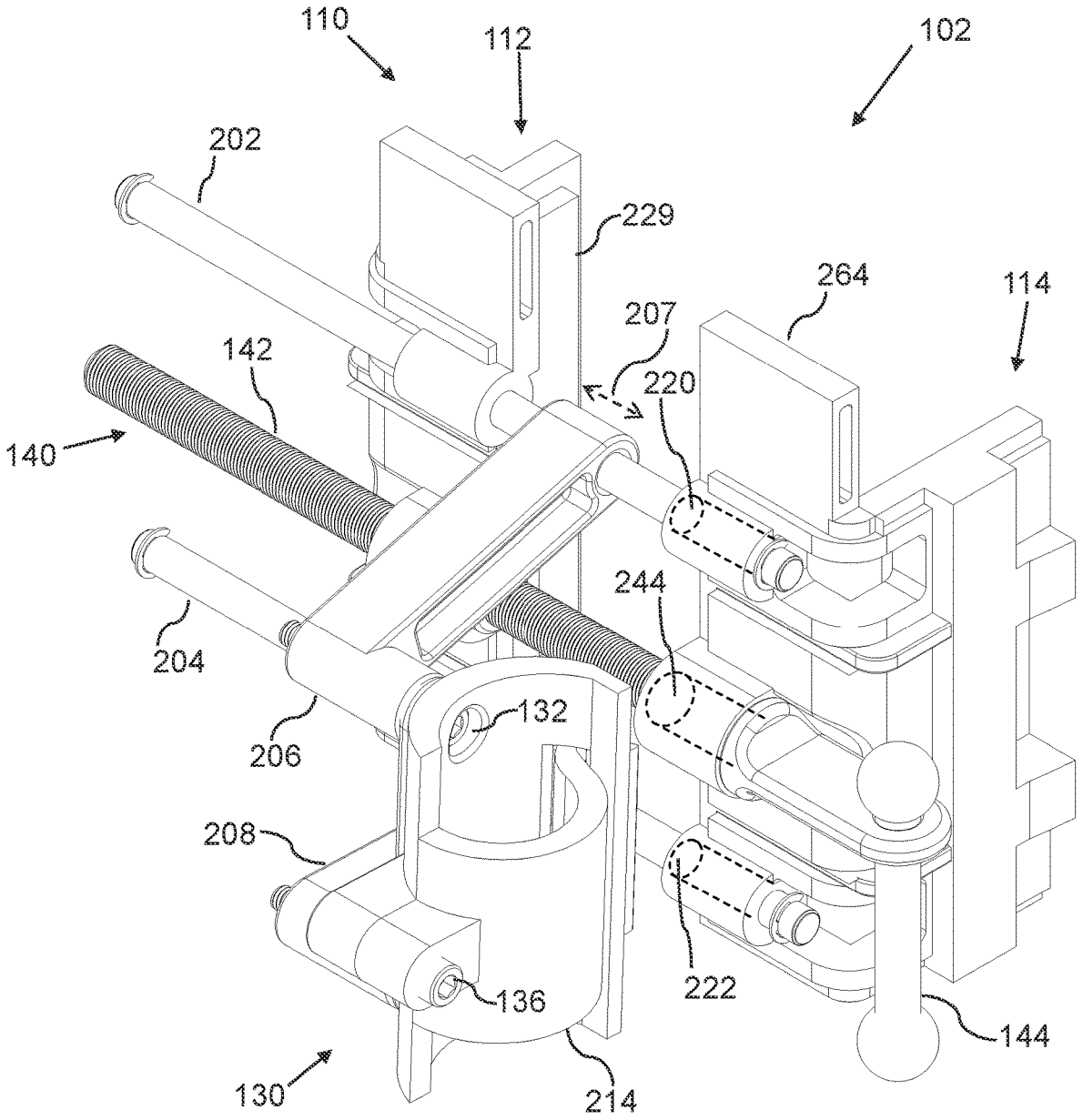
FIG. 2B is a top right perspective view of a massage gun mounting device, according to an embodiment of the invention.
Figure 2C:
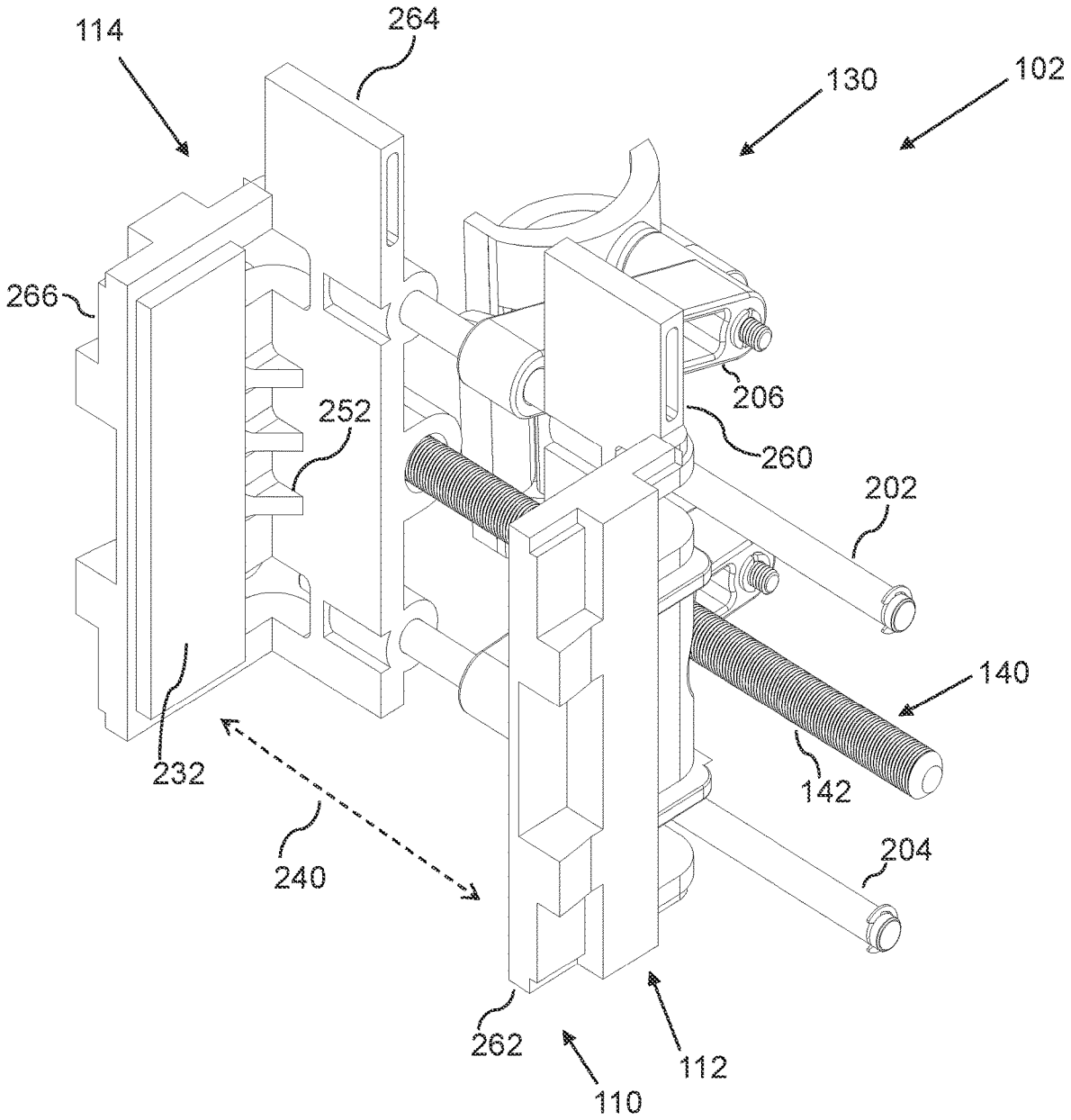
FIG. 2C is a top back left perspective view of a massage gun mounting device, according to an embodiment of the invention.
Figure 2D:
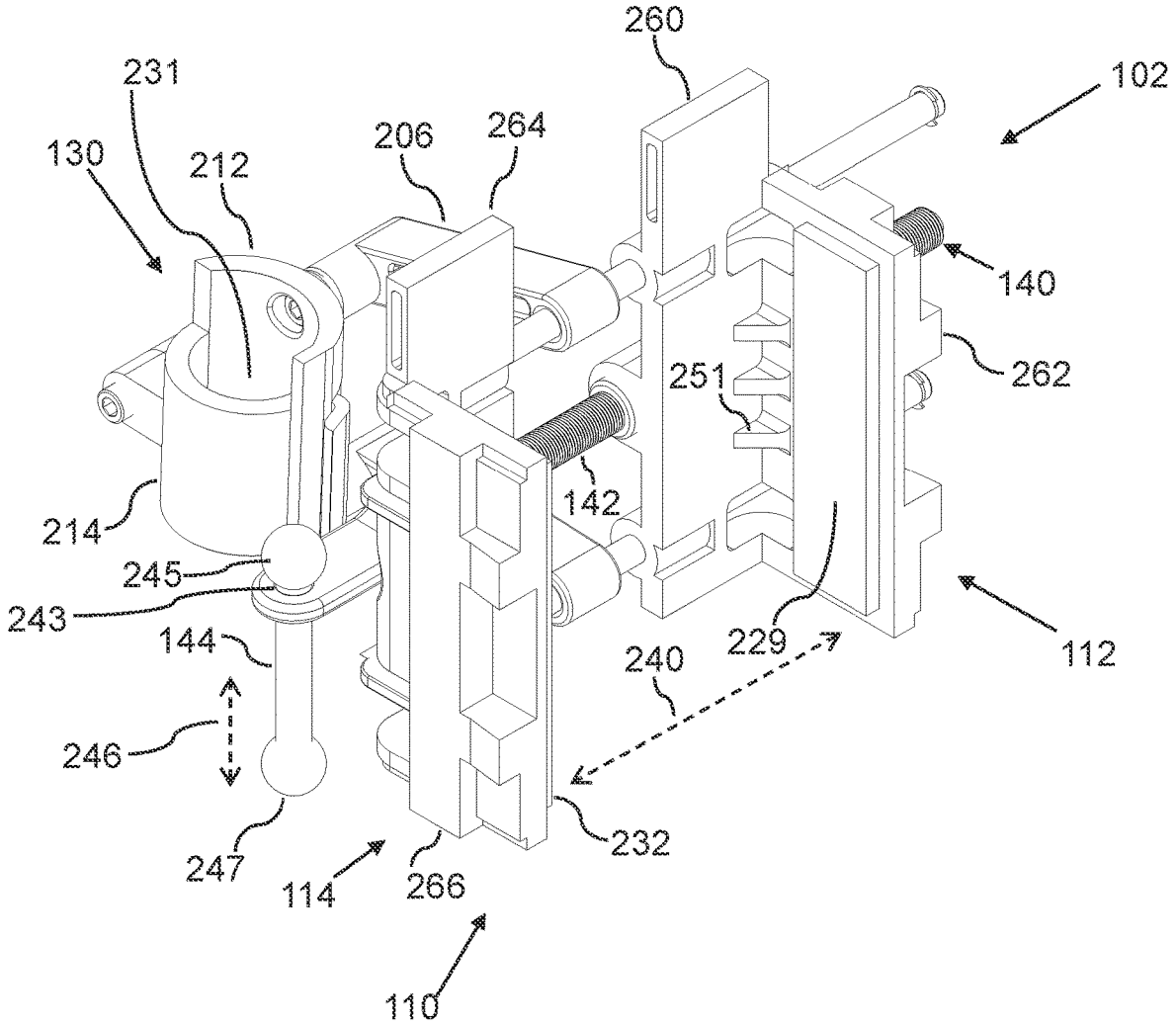
FIG. 2D is a top back right perspective view of a massage gun mounting device, according to an embodiment of the invention.
Figure 2E:
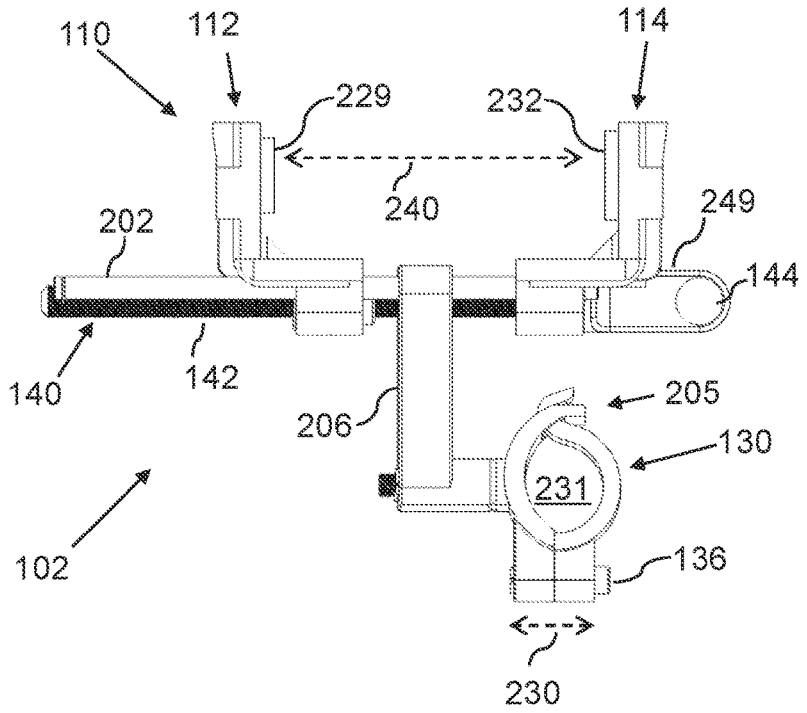
FIG. 2E is a top perspective view of a massage gun mounting device, according to an embodiment of the invention.
Figure 2F:
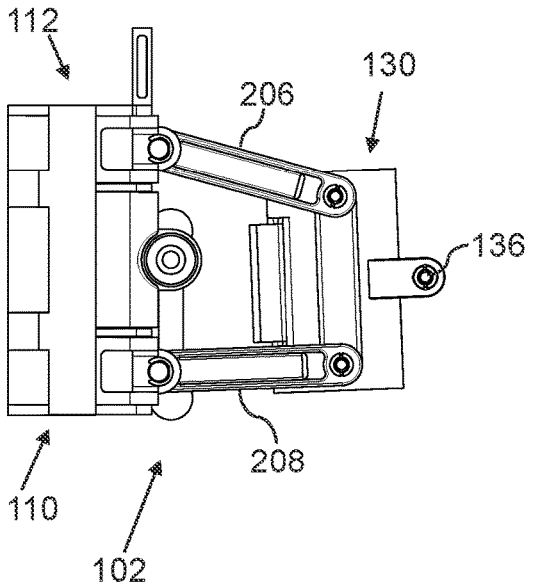
FIG. 2F is a left perspective view of a massage gun mounting device, according to an embodiment of the invention.

In an embodiment, as shown in FIGS. 1, 2A-2G, 11A-11D, a massage gun mounting system 100 for use by a user 194 to self-administer massage can include:

a) a massage gun mounting device 102, 1102, which can include:
   i. a structure connector 110, 1110; and
   ii. a massage gun holder 130, 1130, which is connected to the structure connector 110;
      wherein the massage gun holder 130, 1130 can include a vertical aperture 231 (as shown in FIGS. 2D and 2E); and b) a massage gun device 180, which can include:
   i. a handle member 182; and
   ii. a massage delivery member 184;

wherein the structure connector 110, 1110 can be configured to securely and detachably attach the massage gun mounting device 102 to a mounting structure 192; and wherein the massage gun holder 130, 1130 can be configured to receive the handle member 182 of the massage gun device 180, such that the handle member 182 can be insertable into the vertical aperture 231 of the massage gun holder 130, 1130, such that the massage gun holder 130, 1130 can be configured to hold the handle member 182 securely, whereby the massage gun mounting device 102, 1102 holds the massage gun device 180 securely;

whereby the massage gun device 180 is stably and safely positionable in a convenient position on the mounting structure 192, such that the user 194 can apply pressure to a body area 196 of the user 194, with the massage delivery member 184 of the massage gun device 180, for example during use for rehabilitation or physical exercise in a gym setting, such as a sports training center, fitness center, or in-home exercise environment.

In a related embodiment, as shown in FIGS. 1, 2A, and 2B, the structure connector 110 can include:

a) a left clamp portion 112;

b) a right clamp portion 114, which is connected to the left clamp portion 112, via the upper and lower connector rods 202, 204 and the adjustment rod 140; and c) an adjustment rod 140, as shown in FIG. 2A;

wherein the structure connector 110 is configured to enable adjustment of a lateral gap 240 between the left clamp portion 112 and the right clamp portion 114, to match a thickness 193 of the mounting structure 192;

wherein the adjustment rod 140 is rotatably connected between the left clamp portion 112 and the right clamp portion 114, such that the adjustment rod 140 protrudes through the left clamp portion 112 and the right clamp portion 114;

wherein the adjustment rod 140 is configured such that a rotation 248 of the adjustment rod 140 is configured to adjust a lateral gap 240 between the left clamp portion 112 and the right clamp portion 114, such that the lateral gap 240 is adjustable to match the thickness 193 of the mounting structure 192.

Figure 3A:
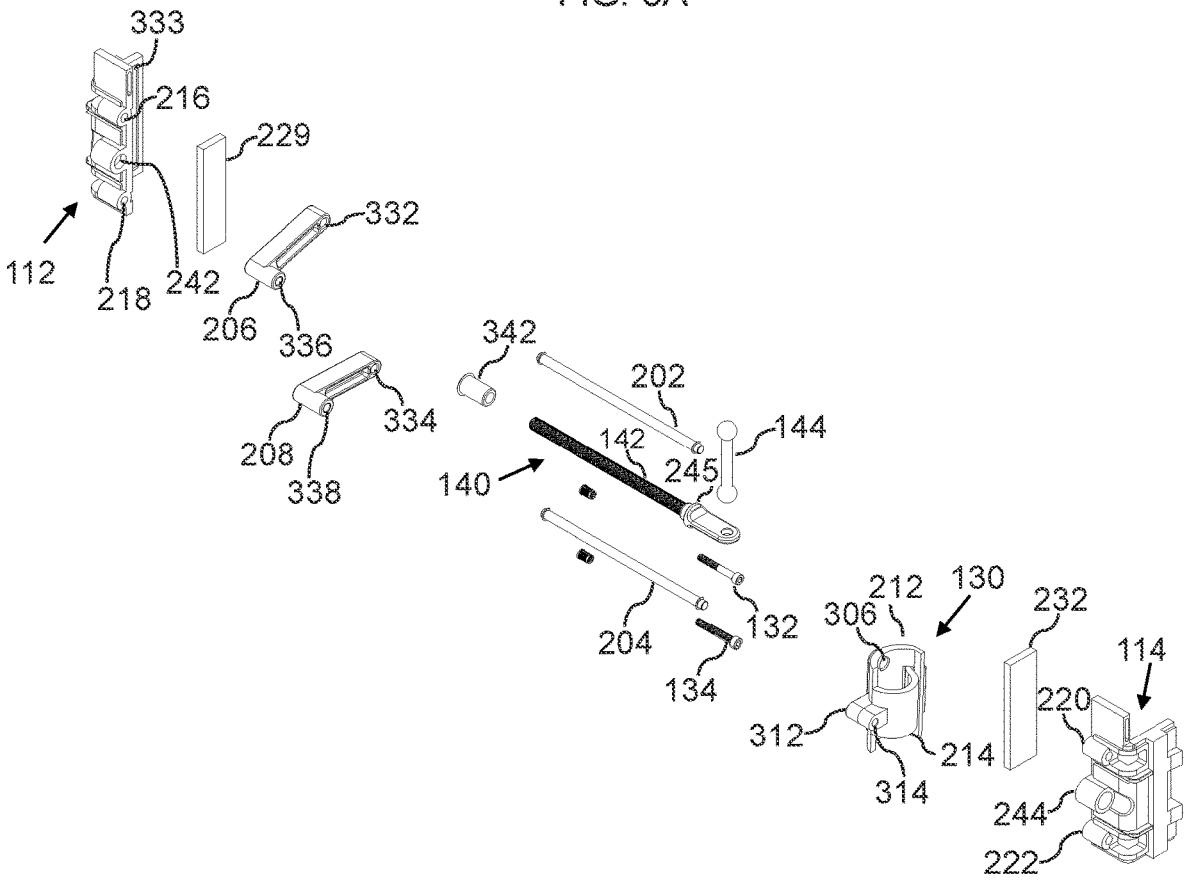
FIG. 3A is a top right exploded part view of a massage gun mounting device, according to an embodiment of the invention.
Figure 3B:
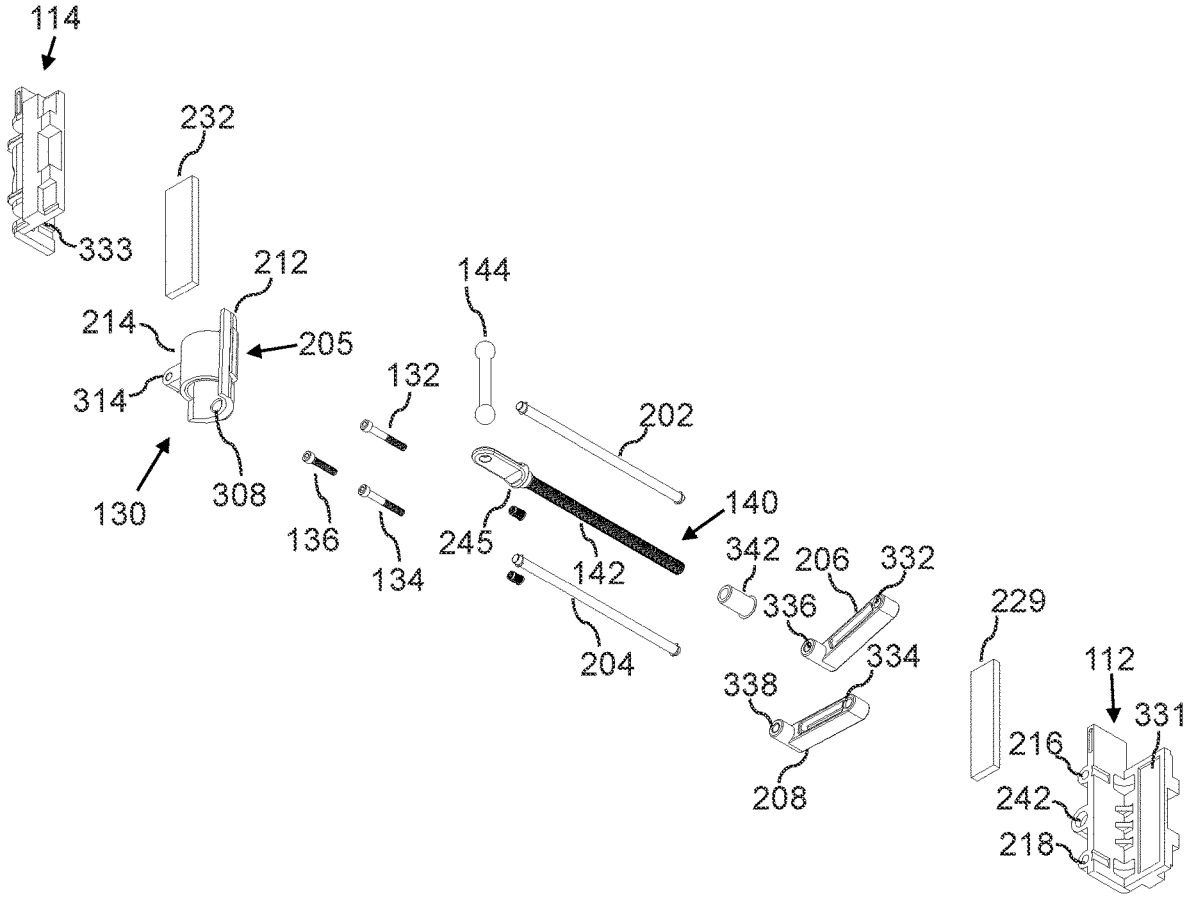
FIG. 3B is a bottom left exploded part view of a massage gun mounting device, according to an embodiment of the invention.
Figure 3C:
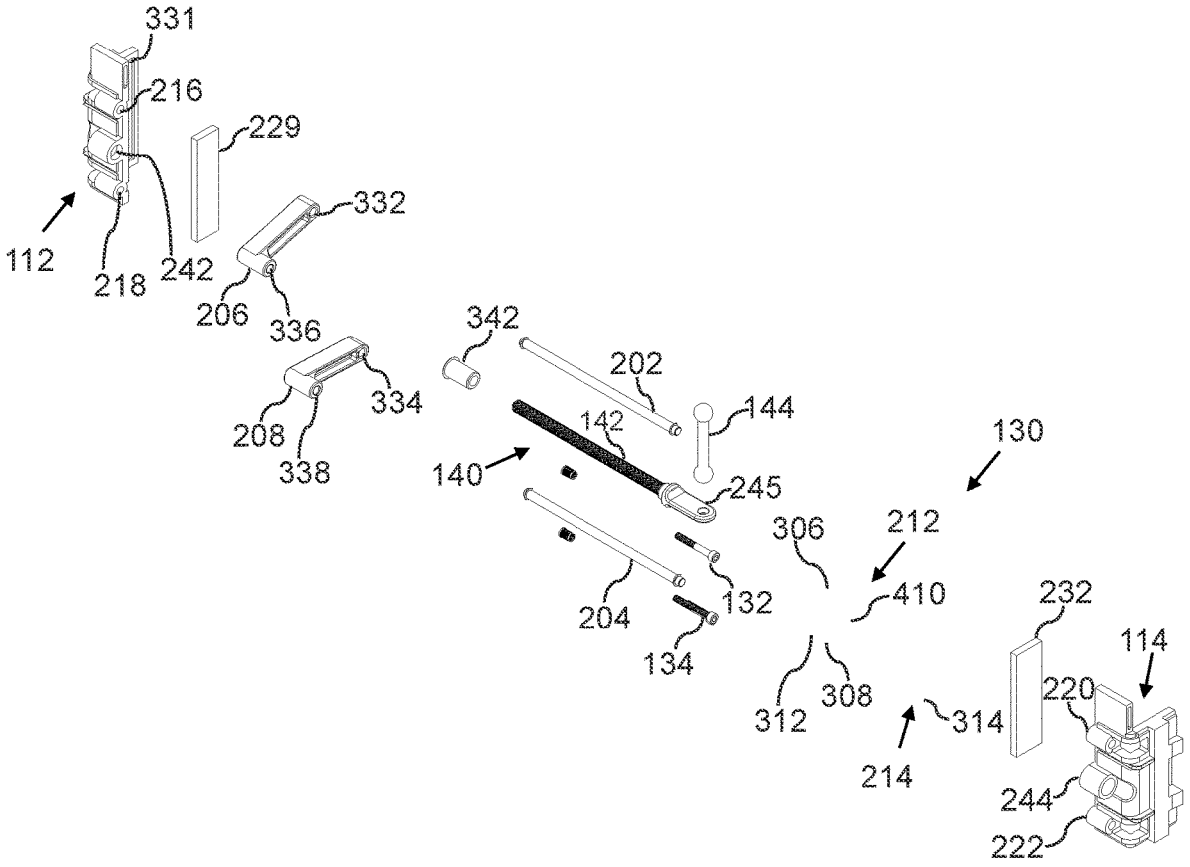
FIG. 3C is a top right exploded part view of a massage gun mounting device showing the massage gun holder disassembled, according to an embodiment of the invention.

In a further related embodiment, as shown in FIGS. 2A, 2B, and 3A-3C, the adjustment rod 140 can further include:

a) an elongated threaded shaft 142, which can be configured to protrude through the right clamp aperture 244 and the left clamp aperture 242, whereby connecting left clamp portion 112 to right clamp portion 114 such that through the turn of; and b) a tightening bolt 342, as shown in FIGS. 3A-3C, that can be configured to connect to the elongated threaded shaft 142 at the end section of the left clamp aperture 242 and secures the adjustment rod 140 in place.

In a related embodiment, as shown in FIGS. 2A, 2B, and 2D, the structure connector 110 can further include:

a) a movement lever 144, which is slidably 246 and perpendicularly connected to an outer end (which may be non-threaded) of the adjustment rod 140, as shown in FIG. 2D, such that the movement lever 144 protrudes through a rod aperture 243 of the outer end of the adjustment rod 140, such that the movement lever 144 facilitates the rotation 248 of the adjustment rod 140 to adjust the lateral gap 240;

b) first and second movement lever stoppers 245, 247, which are connected to first and second ends of the movement lever 144, such that the first and second movement lever stoppers 245, 247 are configured to hold the movement lever 144 in place on the adjustment rod 140; and c) a rod stopper 249, that is configured (or connected to) at a right outer end of the adjustment rod 140 and configured to hold the adjustment rod 140 in position, such that the rod stopper 249 is wider than a width of the rod aperture 243 of the outer end of the adjustment rod 140, to prevent a leftward movement of the adjustment rod 140;

wherein the left clamp aperture 242 can be configured with threading 253, such that the adjustment rod 140 screws through the left clamp aperture 242, such that the adjustment rod 140 rotatably protrudes through the left clamp aperture 242 and the right clamp aperture 244, such that the rod stopper 249 holds the adjustment rod 140 in place at the right clamp aperture 244 (i.e., preventing at least leftward lateral movement of the adjustment rod 140), such that a first direction rotation 248 of the adjustment rod 140 causes the left clamp portion 112 to be pulled inward, thereby reducing the lateral gap 240 between the left clamp portion 112 and the right clamp portion 114.

In a further related embodiment, as shown in FIGS. 2A, 2B, and 3A-3C, the left clamp portion 112 can further include:

a) a left clamp aperture 242, as shown in FIG. 2A, which protrudes through a front portion of the left front plate 260 of the left clamp portion 112, wherein the left clamp aperture 242 can be configured with an internal threading 253;

such that the elongated threaded shaft 142 can protrude through (and optionally screw through) the left clamp aperture 242.

In a further related embodiment, as shown in FIGS. 2A, 2B, and 3A-3C, the right clamp portion 114 can further include:

a) a right clamp aperture 244, as shown in FIG. 2B, which protrudes through a front portion of the right front plate 264 of the right clamp portion 114, wherein the right clamp aperture 244 can be configured with an internal threading;

such that the elongated threaded shaft 142 can protrude through (and optionally screw through) the right clamp aperture 244.

In a related embodiment, as shown in FIGS. 2A, 2B, 2C, 2D, and 3A-3C, the structure connector 110 can further include:

a) an upper connector rod 202, which is connected between the left clamp portion 112 and the right clamp portion 114, such that a left portion of the upper connector rod 202 is laterally slidably connected to the left clamp portion 112, such that the left portion of the upper connector rod protrudes through the left clamp portion 112;

such that a right portion of the upper connector rod 202 is laterally slidably connected to the right clamp portion 114 such that the right portion of the upper connector rod 202 protrudes through the right clamp portion 114; and b) a lower connector rod 204, which is connected between the left clamp portion 112 and the right clamp portion 114, such that the lower connector rod 204 is mounted below the upper connector rod 202, such that a left portion of the lower connector rod 204 is laterally slidably connected to the left clamp portion 112, such that the left portion of the lower connector rod 204 protrudes through the left clamp portion 112;

such that a right portion of the lower connector rod 204 is laterally slidably connected to the right clamp portion 114 such that the right portion of the lower connector rod 204 protrudes through the right clamp portion 114; and whereby the upper connector rod 202 and the lower connector rod 204 can function as a structural framework to stabilize the structure connector 110 and enable adjustable connection of the structure connector to the mounting structure 192.

In a further related embodiment, as shown in FIGS. 2A, 2B, and 3A-3C, the left clamp portion 112 can further include:

a) an upper left rod aperture 216; and b) a lower left rod aperture 218;

such that the upper connector rod 202 can protrude through the upper left rod aperture 216; and such that the lower connector rod 204 can protrude through the lower left rod aperture 218.

In a further related embodiment, as shown in FIGS. 2A, 2B, and 3A-3C, the right clamp portion 114 can further include:

a) an upper right rod aperture 220; and b) a lower right rod aperture 222;

such that the upper connector rod 202 can protrude through the upper right rod aperture 220; and such that the lower connector rod 204 can protrude through the lower right rod aperture 222.

In further related embodiment, as shown in FIGS. 2B, 3A-3C, the structure connector 110 can further include:

a) a left protective pad 229 as shown in FIGS. 3A-3C, wherein the left protective pad 229 can be mounted on a right inner side of the left clamp portion 112, such that the left protective pad 229 protrudes from the left clamp portion 112 to prevent excessive pressure and structural damage and to provide adequate surface tension to secure surface hold to mounting structure 192;

wherein the right inner side of the left clamp portion 112 can further include:

i. a left pad receiving indentation 331 on the right inner side of the left clamp portion 112 that can be configured to receive the left protective pad 229, such that an inner portion of the left protective pad 229 can be inserted into the left pad receiving indentation 331; and b) a right protective pad 232 as shown in FIGS. 3A-3C, wherein the right protective pad 232 can be mounted on a right inner side of the right clamp portion 114, such that the right protective pad 232 protrudes from the right clamp portion 114, to prevent excessive pressure and structural damage and to provide adequate surface tension to secure surface hold to mounting structure 192;

wherein a left inner side of the right clamp portion 114 can further include:

i. a right pad receiving indentation 333 on the left inner side of the right clamp portion 114 that can be configured to receive the right protective pad 232, such that an inner portion of the right protective pad 232 can be inserted into the right pad receiving indentation 333;

wherein the right protective pad 232 and the left protective pad 229 can be made of a resilient material, such as a rubber material that can be synthetic or natural rubber, to prevent excessive pressure and structural damage and to provide adequate surface tension to secure a hold on the mounting structure 192;

In a further related embodiment, as shown in FIGS. 2A and 2D, the left clamp portion 112 can further include:

a) a left front plate 260, which can be a rectangular portion, configured to be mounted to a mounting structure 192; and b) a left side plate 262, which can be a rectangular portion, comprising of a left pad receiving indentation 331 and left protective pad 229 configured to be mounted to a mounting structure 192; and wherein the left front plate 260 is perpendicularly connected to the left side plate 262 along the vertical edge of the left front plate 260;

In a further related embodiment, as shown in FIGS. 2A and 2D, the right clamp portion 114 can further include:

a) a right front plate 264, which can be a rectangular portion, configured to be mounted to a mounting structure 192; and b) a right side plate 266, which can be a rectangular portion, comprising a right pad receiving indentation 333 and a right protective pad 232 configured to be mounted to a mounting structure 192; and wherein the right front plate 264 is perpendicularly connected to the right side plate 266 along the vertical edge of the right front plate 264;

In a further related embodiment, as shown in FIG. 2C, the right clamp portion 114 can further include:

a) at least one right support member 252, which is mounted in an inner corner between the right front plate 264 and the right side plate 266, such that the at least one right support member 252 provide additional structural support of the right clamp portion 114.

In a further related embodiment, as shown in FIG. 2D, the left clamp portion 112 can further include:

a) at least one left support member 251, which is mounted in an inner corner between the left front plate 260 and the left side plate 262, such that the at least one left support member 251 provides additional structural support of the left clamp portion 112.

In various further related embodiments, the right protective pad 232 and the left protective pad 229 can be built of synthetic or natural rubber material, such as silicone or latex.

Figure 4A:
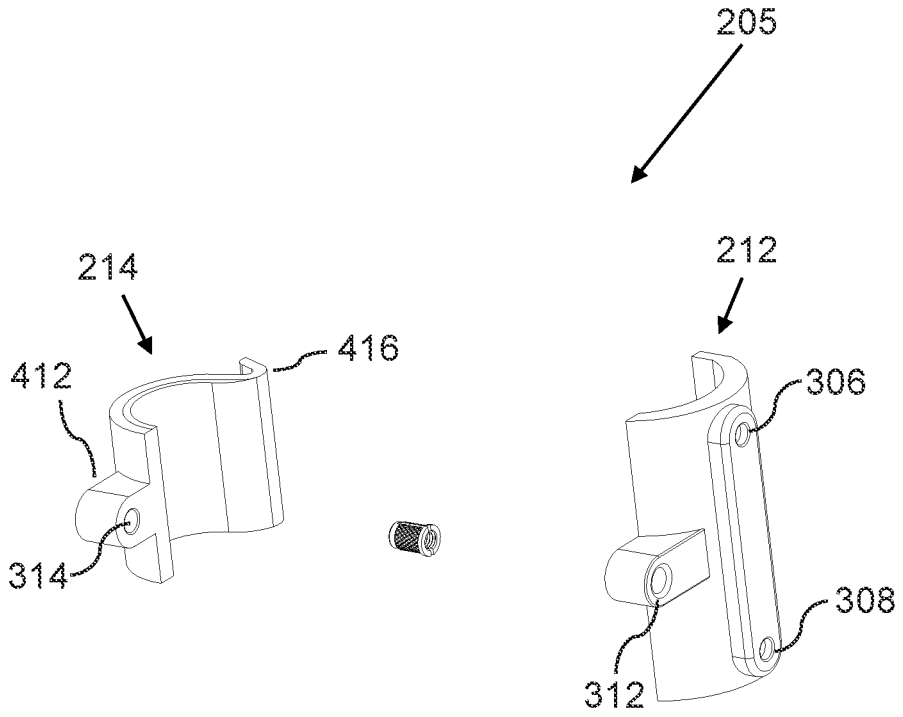
FIG. 4A is a front exploded perspective view of the massage gun holder, according to an embodiment of the invention.
Figure 4B:
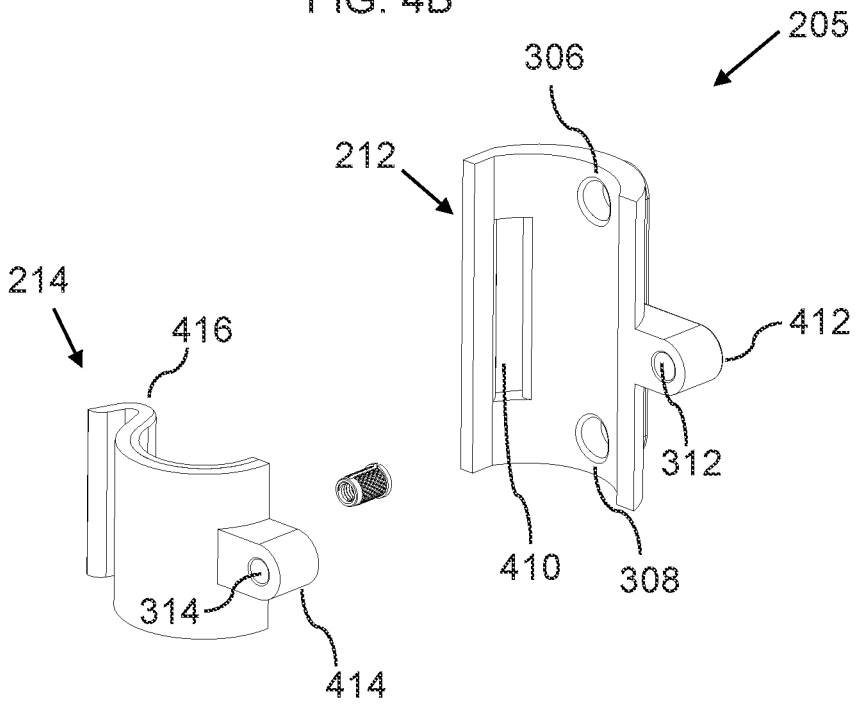
FIG. 4B is a back exploded perspective view of the massage gun holder, according to an embodiment of the invention.

In an embodiment, as shown in FIGS. 3A-3C, the massage gun holder 130 can further include:

a) a left holder portion 212, which can be a concave cylinder segment with a left protruding arm member 412, wherein the left holder portion 212 includes an elongated aperture 410 in an inner end of the left holder portion 212, wherein the left holder portion 212 is configured to hold a left side of the handle member of the massage gun device 180; and b) a right holder portion 214, which can be a concave cylinder segment with a right protruding arm member 414, as shown in FIG. 4A-4B, wherein the right holder portion 214 is configured to hold a right side of the handle member of the massage gun device 180;

wherein the left protruding arm member 412, can contain a left holder screw aperture 312, and the right protruding arm member 414, can contain a right holder screw aperture 314;

wherein the left holder portion can be flexibly connected to the right holder portion along a vertical length of rear ends of the left holder portion 212 and the right holder portion 214;

wherein, the elongated aperture 410 on the left holder portion 212 can be configured to receive and connect to the hook shaped portion 416 on the right holder portion 214 at the rear end of massage gun holder 130; and the hook shaped portion 416 is configured to be inserted into the elongated aperture 410;

whereby the left holder portion 212 and the right holder portion 214 portion create a hinge 205 such that the left holder portion 212 and the right holder portion 214 form the massage gun holder 130, which is configured to hold the massage gun device 180 with a hinge on the rear end, being closed by a front adjustable screw 136 that screws through the left holder screw aperture 312 and right holder screw aperture 314, where if loosened, the massage gun device 180 can be removed and the massage gun holder 130 and its left holder portion 212 and right holder portion 214 can be separated by taking the hook shaped portion 416 out of the elongated aperture 410 after the front adjustable screw 136 is loosened.

In further related embodiment, as shown in FIG. 3A-3C, wherein the massage gun holder 130 can include:

a) a hinge 205, as shown in FIGS. 2E and 3B, which can be mounted between the rear ends of the left holder portion 212 and the right holder portion 214, wherein the hinge 205 can be configured as a living hinge; or alternatively, the massage gun holder 130 can be configured without the hinge, with specific dimension to hold a set diameter;

wherein the hinge 205, as shown in FIGS. 4A and 4B, can be comprised of the left holder portion 212 and the right holder portion 214, such that an inner end of the right holder portion 214 interlocks with an inner end of the left holder portion 212, such that the inner end of the right holder portion 214 protrudes through an elongated aperture 410 of an inner end of the left holder portion 212.

wherein an inner end of the right holder portion 214 can include a hook shaped portion 416, such that the hook shaped portion 416 of the right holder portion 214, is configured to be inserted into the elongated aperture 410 of the left holder portion 212, such that the rear ends of the left holder portion 212 and the right holder portion 214 are interlocked, such that the elongated aperture 410 and the hook shaped portion form the hinge 205, whereby the hinge 205 is detachable;

such that the massage gun holder 130 is configured to receive the massage gun device 180.

In another related embodiment, as shown in FIGS. 2A, 2B, 2C, 3A and 3B, the massage gun mounting device 102 can include:

a) an upper holder arm 206, which is an elongated member, which can include:

i. an upper inner arm aperture 332, as shown in FIGS. 3A and 3B, in an inner end of the upper holder arm 206, such that the upper connector rod 202 protrudes through the upper inner arm aperture 332, such that the inner end of the upper holder arm 206 is slidably 207 and rotatably 209 attached to the upper connector rod 202, as shown in FIGS. 2A and 2B; and ii. an upper outer arm aperture 336, in an outer end of the upper holder arm 206, such that the outer end of the upper holder arm 206 is configured to rotatably attach to the massage gun holder 130 with an upper adjustable arm screw 132 penetrating the massage gun holder 130 and screwing into the upper outer arm aperture 336; and b) a lower holder arm 208, which is an elongated member, which can include:

i. a lower inner arm aperture 334, as shown in FIGS. 3A-3C, in a first end of the upper holder arm, such that the lower connector rod 204 protrudes through the lower inner arm aperture 334, such that the inner end of the lower holder arm 208 is slidably and rotatably attached to the lower connector rod 204; and ii. a lower outer arm aperture 338 in an outer end of the lower holder arm 208, such that the outer end of the lower holder arm 208 is configured to rotatably attach to the massage gun holder 130 with a lower adjustable arm screw 134 penetrating the massage gun holder 130 and screwing into the lower outer arm aperture 338;

such that the upper holder arm 206 and the lower holder arm 208 connect the structure connector 110 to the massage gun holder 130.

In various further related embodiments, the holder arms 206, 208 can facilitate use for a multitude of different applications and be built to accommodate a sliding/bending feature to vary the position or location of the massage gun device 180.

Figure 2G:
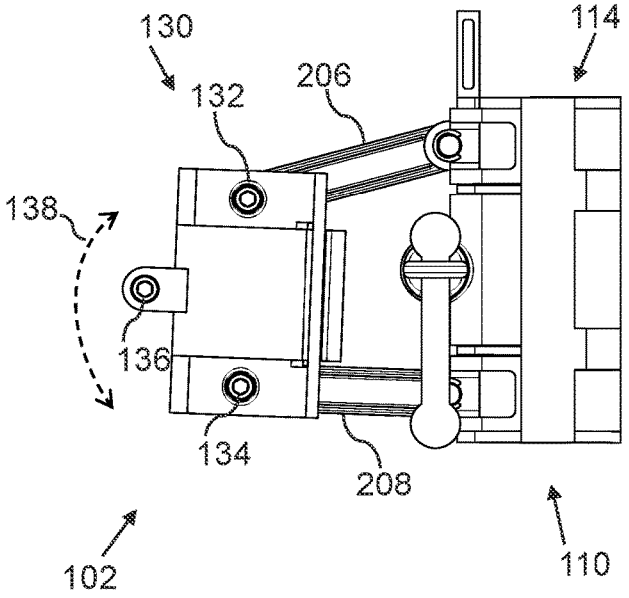
FIG. 2G is a right perspective view of a massage gun mounting device, according to an embodiment of the invention.

In a further related embodiment, as shown in FIGS. 2B, 2C, 2F, 2G and 3A-3C, the massage gun holder 130, can further include:

a) an upper adjustable arm screw 132, which, as shown in FIGS. 2B and 3A, screws through an upper left holder screw aperture 306 of the of the left holder portion 212;

such that the upper left holder screw aperture 306 can be positioned in a central portion of the left holder portion 212;

such that the upper adjustable arm screw 132 can be configured to screw through the upper left holder screw aperture 306 of the left holder portion 212 of the massage gun device 180 into the outer end of the upper holder arm 206;

b) a lower adjustable arm screw 134, which, as shown in FIGS. 2B and 3B, screws through a lower left holder screw aperture 308;

such that the lower left holder screw aperture 308 can be positioned in a central portion of the left holder portion 212;

such that the lower adjustable arm screw 134 can be configured to screw through the lower left holder screw aperture 308 of the left holder portion 212 into the outer end of the lower holder arm 208; and such that tightening of the upper adjustable arm screw 132 and the lower adjustable arm screw 134 locks the massage gun holder 130 in a selected position; and such that loosening of the upper adjustable arm screw 132 and the lower adjustable arm screw 134 enables a pivotable motion 138 of the massage gun holder 130, as shown in FIG. 2G, such that the massage gun holder 130 is pivotable to a selected position; and c) a front adjustable screw 136, which, as shown in FIG. 2E, screws through a right holder screw aperture 314 of the right holder portion 214 into a left holder screw aperture 312 of the left holder portion 212;

such that the front adjustable screw 136 is configured to screw through outer ends of the right protruding arm member 414, of the right holder portion 214 and the left protruding arm member 412, of the left holder portion 212 of the massage gun holder 130;

such that the right holder screw aperture 314 can be positioned on an outer end of the right protruding arm member 414, of the right holder portion 214;

such that the left holder screw aperture 312 can be positioned on the outer end of the left protruding arm member 412, of the left holder portion 212;

such that a rotation of the front adjustable screw 136 changes a width of a lateral holder gap 230 between front ends of the right holder portion 214 and left holder portion 212;

such that clockwise rotational movements or counter-clockwise rotational movements of the front adjustable screw 136 causes the lateral holder gap 230 to respectively contract or expand.

In a related embodiment, inner surfaces of the left holder portion 212 and the right holder portion 214 can be concave cylinder segments.

In various further related embodiments, the massage gun holder 130 can facilitate use for a multitude of different applications and be configured alternatively be configured to receive a specified massage gun device 180 dimension and be configured without necessity of the lateral holder gap 230 and adjustability.

Figure 5:
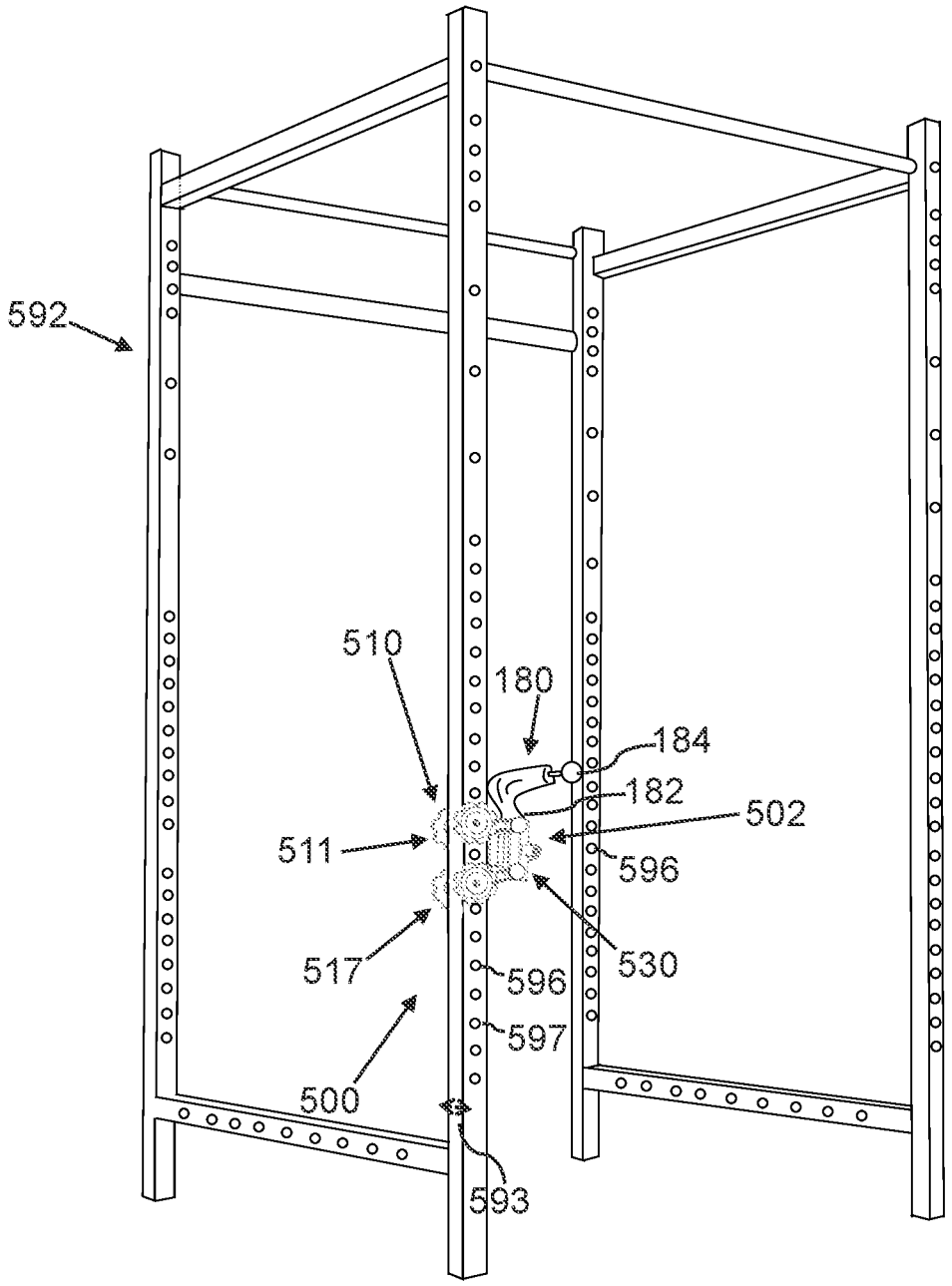
FIG. 5 is a schematic diagram illustrating a massage gun mounting device system in use, according to an embodiment of the invention.
Figure 6A:
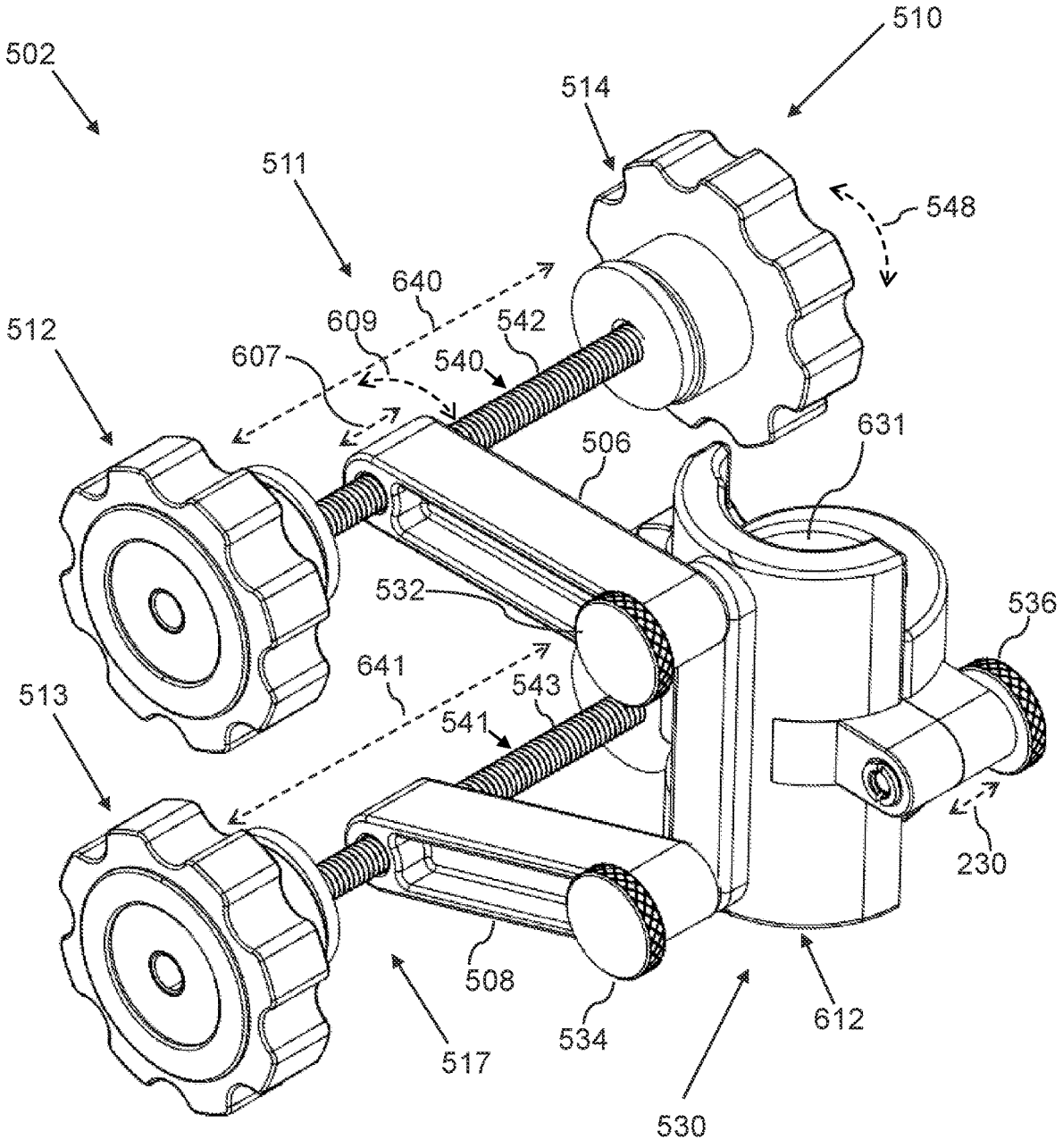
FIG. 6A is a top left perspective view of a massage gun mounting device, according to an embodiment of the invention.
Figure 6B:
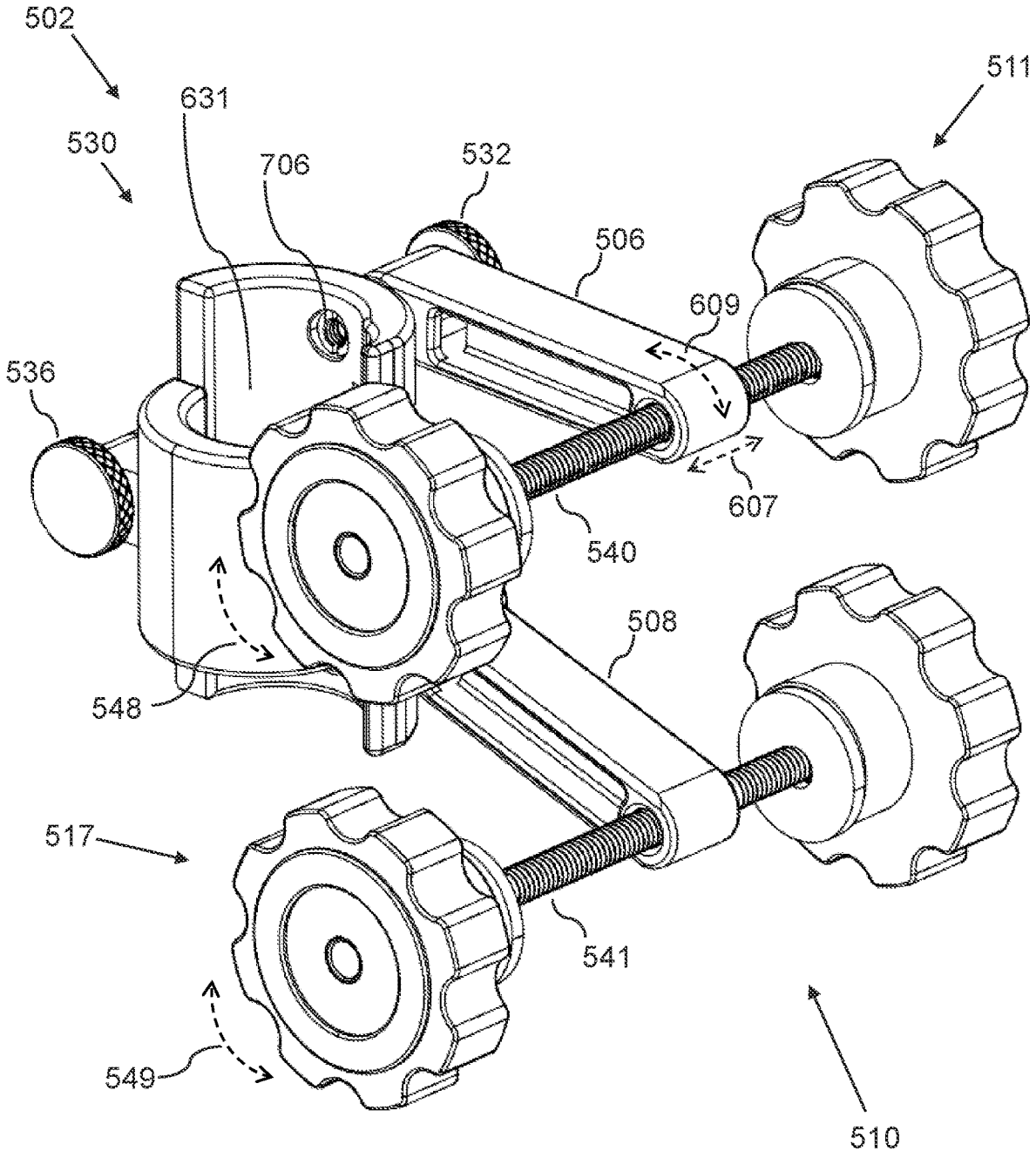
FIG. 6B is a top back right perspective view of a massage gun mounting device, according to an embodiment of the invention.

In the following, as shown in FIG. 5, we describe the structure of an embodiment of a massage gun mounting system 500, which includes a massage gun mounting device 502, which can be a reconfiguration of the massage gun mounting system 100 with a replacement rod structure connector 510, which replaces the clamp structure connector 110, such that the massage gun mounting system 500 is configured for mounting on a mounting structure 592, which is configured as a conventional fitness training rack system, such a squat rack system, which includes vertical columns (and other rack structures, such as horizontal columns) with uniformly spaced rack apertures 596, which protrude through the vertical columns (or rack structure in general), such that the rack apertures 596 can enable attachment of various types of fitness equipment for use with the squat rack system. Thus, the massage gun holder 130, 530, with an attached upper holder arm 206, 506 and an attached lower holder arm 206, 506 can permit connection of either a clamp structure connector 110 (as shown in FIG. 1) or a rod structure connector 510 (as shown in FIGS. 5, 6A, and 6B), to enable attachment of the massage gun mounting device 102, 502 to different types of mounting structures 192, 592.

In an embodiment, as shown in FIGS. 5, 6A, 6B, 6D, 6E, 7, 8, and 9, a massage gun mounting system 500 for use by a user 194 (as shown in FIG. 1) to self-administer massage can include:

a) a massage gun mounting device 502, which can include:
   i. a structure connector 510, 110, which can include:
      1. an upper connector assembly 511; and
      2. a lower connector assembly 517; and
   ii. a massage gun holder 530, which is connected to the structure connector 110;
      wherein the massage gun holder 530 can include a first vertical aperture 631; and b) a massage gun device 180, which can include:
   i. a handle member 182; and
   ii. a massage delivery member 184;

wherein the structure connector 510 can be configured to securely and detachably attach the massage gun mounting device 502 to a mounting structure 592; and wherein the massage gun holder 530 can be configured to receive the handle member 182 of the massage gun device 180, such that the handle member 182 can be insertable into the massage gun holder 530, such that the massage gun holder 530 can be configured to hold the handle member 182 securely, whereby the massage gun mounting device 502 holds the massage gun device 180 securely;

whereby the massage gun device 180 is stably and safely positionable in a convenient position on the mounting structure 592, such that the user 194 can apply pressure to a body area 196 of the user 194, with the massage delivery member 184 of the massage gun device 180.

In a related embodiment, as shown in FIGS. 6A, 6B, 7, and 8, the massage gun mounting system 500 can include:

a) an upper holder arm 506, 206, which can be configured with an upper inner arm aperture 632, 332 in an inner end of the upper holder arm 506, 206; and b) a lower holder arm 508, 208, which can be configured with a lower inner arm aperture 634, 334 in an inner end of the lower holder arm 508, 208.

In a related embodiment, as shown in FIGS. 6A, 6B, 6C, 7, and 8, the upper connector assembly 511 can include:

a) an upper connector rod 540, which can include an upper elongated threaded shaft 542, as shown in FIGS. 6A, 6B, 6C, 7, and 8;

b) A left upper fastener 512, which is configured to screw onto a left end of the upper connector rod 540, wherein the left upper fastener 512 can for example be configured as a threaded nut or a threaded ribbed comfort-grip knob 512 (as shown);

c) A right upper fastener 514, which is configured to screw onto a right end of the upper connector rod, wherein the right upper fastener 514 can for example be configured as a threaded nut or a threaded ribbed comfort-grip knob 514 (as shown);

d) at least one upper left washer 643, which can be mounted on an inner side of the left upper fastener 512, such that the upper left washer 643 protrudes through a left end of the upper connector rod 540; and e) at least one upper right washer 645, which can be mounted on an inner side of the right upper fastener 514, such that the upper right washer 645 protrudes through a right end of the upper connector rod 540;

such that the upper connector rod 540 protrudes through the upper inner arm aperture 632, such that the inner end of the upper holder arm 506 is attached to the upper connector rod 540;

such that the upper connector rod 540 is configured to protrude through an upper connection aperture 596 of the mounting structure 592, such that the upper connector assembly 511 is connected to the mounting structure 592;

such that an outer end of the upper holder arm 506 is connected to the massage gun holder 530;

such that the upper holder arm 506 connects the structure connector 510 to the massage gun holder 530;

such that the left upper fastener 512 and the right upper fastener 514 are configured to tighten the upper connector rod 540 in place on the mounting structure 592, with the upper connector rod 540 protruding through the upper connection aperture of the mounting structure 592, and the upper holder arm connected to the upper connector rod 540, between the left upper fastener and the right upper fastener, which are fastened onto the left and right ends of the upper connector rod 540, respectively;

wherein the upper connector assembly 511 is configured to enable adjustment of a lateral gap 640 between the left upper fastener 512 and the right upper fastener 514, to match a thickness 593 of the mounting structure 592;

wherein the upper connector rod 540 is rotatably connected between the left upper fastener 512 and the right upper fastener 514, such that the upper connector rod 540 protrudes through the left upper fastener 512 and the right upper fastener 514;

wherein the upper connector rod 540 is configured such that a rotation 548 of the upper connector rod 540 is configured to adjust a lateral gap 640 between the left upper fastener 512 and the right upper fastener 514, such that the lateral gap 640 is adjustable to match the thickness 593 of the mounting structure 592.

In a related embodiment, as shown in FIGS. 6A, 6B, 7, and 8, the lower connector assembly 517 can include:

a) a lower connector rod 541, as shown in FIGS. 6A, 6B, 7, and 8;

b) a left lower fastener 513, which is configured to screw onto a left end of the lower connector rod, wherein the left lower fastener 513 can for example be configured as a threaded nut or a threaded ribbed comfort-grip knob 513 (as shown);

c) a right lower fastener 515, which is configured to screw onto a right end of the lower connector rod 541, wherein the right lower fastener 515 can for example be configured as a threaded nut or a threaded ribbed comfort-grip knob 515 (as shown);

d) at least one lower left washer 647, which can be mounted on an inner side of the left lower fastener 513, such that the lower left washer 647 protrudes through a left end of the lower connector rod 541; and e) at least one lower right washer 649, which can be mounted on an inner side of the right lower fastener 515, such that the lower right washer 649 protrudes through a right end of the lower connector rod 541;

such that the lower connector rod 541 protrudes through the lower inner arm aperture 634, such that the inner end of the lower holder arm is attached to the lower connector rod 541;

such that the lower connector rod 541 is configured to protrude through a lower connection aperture 597 of the mounting structure, such that the lower connector assembly 517 is connected to the mounting structure 592;

such that an outer end of the lower holder arm 508 is connected to the massage gun holder 530;

such that the lower holder arm 508 connects the structure connector 510 to the massage gun holder 530;

such that the left lower fastener and the right lower fastener are configured to tighten the lower connector rod in place on the mounting structure, with the lower connector rod 541 protruding through the lower connection aperture 597 of the mounting structure, and the lower holder arm 508 connected to the lower connector rod 541, between the left lower fastener and the right lower fastener, which are fastened onto the left and right ends of the lower connector rod 541, respectively;

wherein the lower connector assembly 517 is configured to enable adjustment of a lateral gap 641 between the left lower fastener 513 and the right lower fastener 515, to match a thickness 593 of the mounting structure 592;

wherein the lower connector rod 541 is rotatably connected between the left lower fastener 513 and the right lower fastener 515, such that the lower connector rod 541 protrudes through the left lower fastener 513 and the right lower fastener 515;

wherein the lower connector rod 541 is configured such that a rotation 549 of the lower connector rod 541 is configured to adjust a lateral gap 641 between the left lower fastener 513 and the right lower fastener 515, such that the lateral gap 641 is adjustable to match the thickness 593 of the mounting structure 592.

Figure 7:
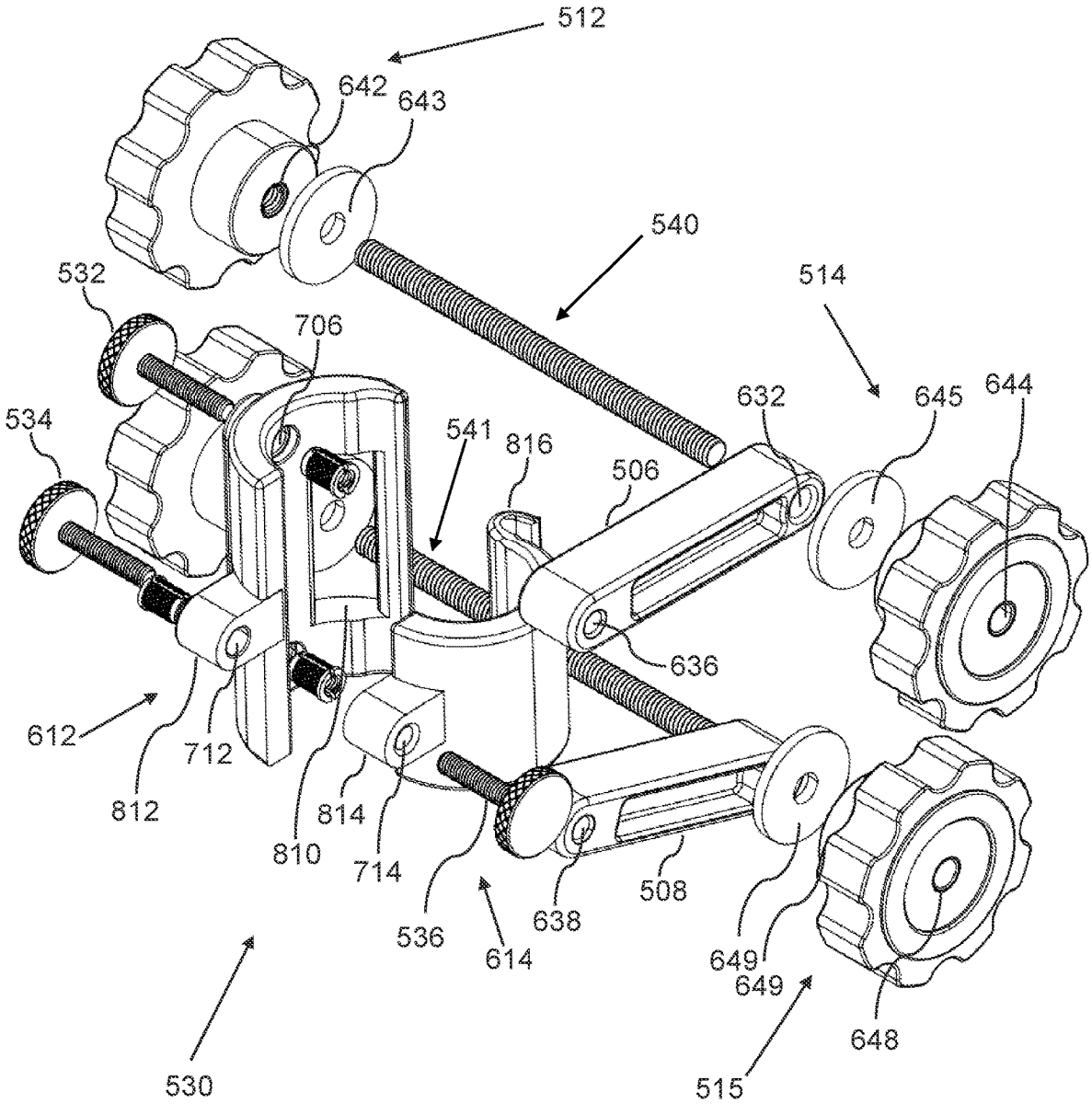
FIG. 7 is a top right exploded part view of a massage gun mounting device, according to an embodiment of the invention.

In a further related embodiment, as shown in FIGS. 6A, 6B, 7, and 8, the left upper fastener 512 can further include:

a) a left upper fastener aperture 642, as shown in FIG. 7, which protrudes through a front portion of the left upper fastener 512, wherein the left upper fastener aperture 642 can be configured with an internal threading;

such that the upper elongated threaded shaft 542 can protrude through (and optionally screw through) the left upper fastener aperture 642.

In a further related embodiment, as shown in FIGS. 6A, 6B, 7, and 8, the right upper fastener 514 can further include:

a) a right upper fastener aperture 644, as shown in FIG. 7, which protrudes through a front portion of the right upper fastener 514, wherein the left upper fastener aperture 644 can be configured with an internal threading;

such that the upper elongated threaded shaft 542 can protrude through (and optionally screw through) the right upper fastener aperture 644.

Figure 8:
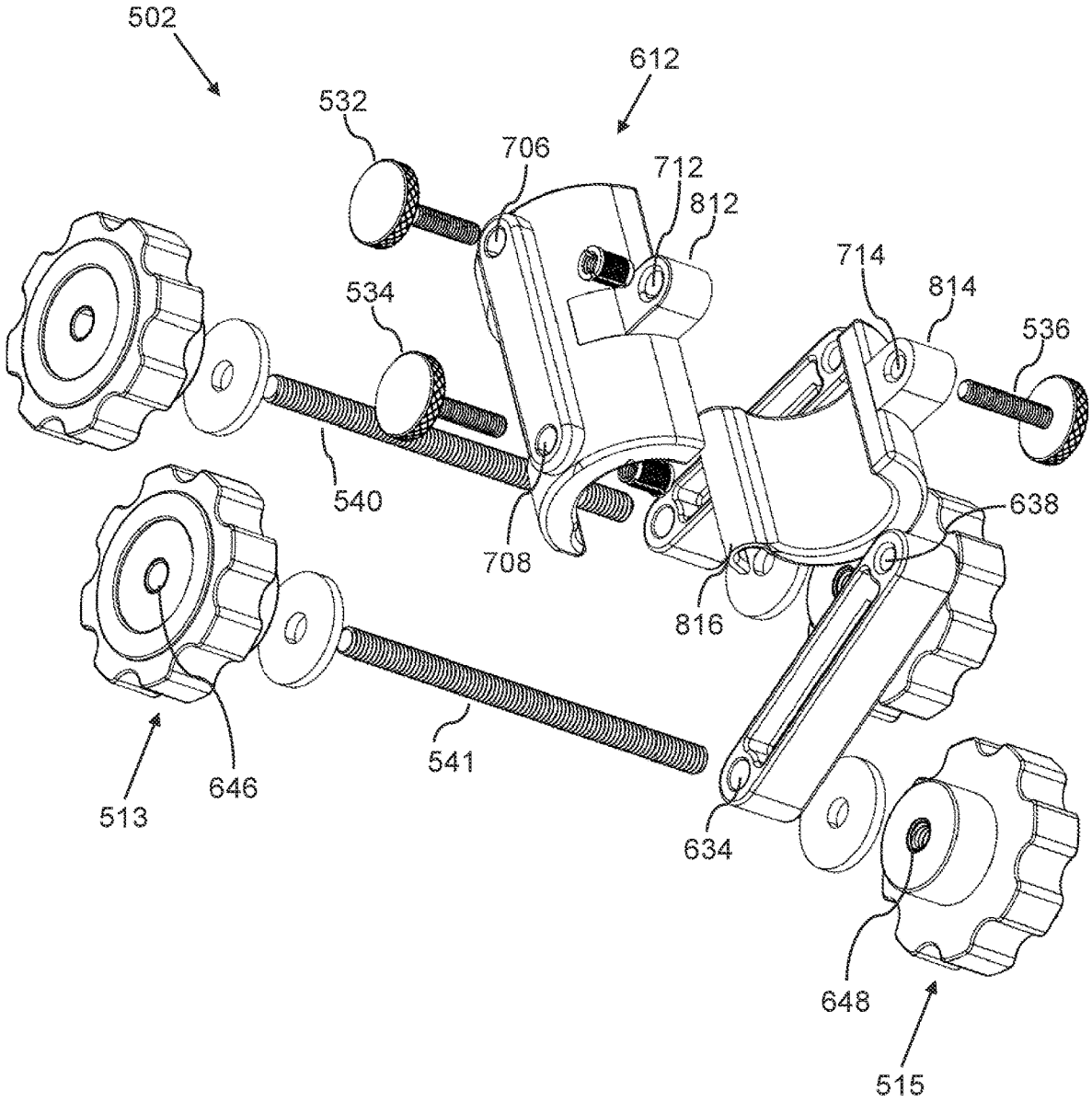
FIG. 8 is a bottom left exploded part view of a massage gun mounting device, according to an embodiment of the invention.

In a further related embodiment, as shown in FIGS. 6A, 6B, 7, and 8, the left lower fastener 513 can further include:

a) a left lower fastener aperture 646, as shown in FIG. 8, which protrudes through a front portion of the left lower fastener 513, wherein the left lower fastener aperture 646 can be configured with an internal threading;

such that the lower elongated threaded shaft 543 can protrude through (and optionally screw through) the left lower fastener aperture 646.

In a further related embodiment, as shown in FIGS. 6A, 6B, 7, and 8, the right lower fastener 515 can further include:

a) a right lower fastener aperture 648, as shown in FIG. 8, which protrudes through a front portion of the right lower fastener 515, wherein the right lower fastener aperture 648 can be configured with an internal threading;

such that the lower elongated threaded shaft 543 can protrude through (and optionally screw through) the right lower fastener aperture 648.

In an embodiment, as shown in FIGS. 6A-6C, 7 and 8, the massage gun holder 530 can further include:

a) a left holder portion 612, which can be a concave cylinder segment with a left protruding arm member 812, wherein the left holder portion 612 includes an elongated aperture 810 in an inner end of the left holder portion 612, wherein the left holder portion 612 is configured to hold a left side of the handle member of the massage gun device 180; and b) a right holder portion 614, which can be a concave cylinder segment with a right protruding arm member 814, as shown in FIGS. 6A, 6B, and 7, wherein the right holder portion 614 is configured to hold a right side of the handle member of the massage gun device 180;

wherein the left protruding arm member 812, can contain a left holder screw aperture 712, and the right protruding arm member 814, can contain a right holder screw aperture 714;

wherein the left holder portion can be flexibly connected to the right holder portion along a vertical length of rear ends of the left holder portion 612 and the right holder portion 614;

wherein, the elongated aperture 810 on the left holder portion 612 can be configured to receive and connect to the hook shaped portion 816 on the right holder portion 614 at the rear end of massage gun holder 530; and the hook shaped portion 816 is configured to be inserted into the elongated aperture 810;

whereby the left holder portion 612 and the right holder portion 614 portion create a hinge 605 such that the left holder portion 612 and the right holder portion 614 form the massage gun holder 530, which is configured to hold the massage gun device 180 with a hinge on the rear end, being closed by a front adjustable screw 536 that screws through the left holder screw aperture 712 and right holder screw aperture 714, where if loosened, the massage gun device 180 can be removed and the massage gun holder 530 and its left holder portion 612 and right holder portion 614 can be separated by taking the hook shaped portion 816 out of the elongated aperture 810 after the front adjustable screw 536 is loosened.

Figure 6C:
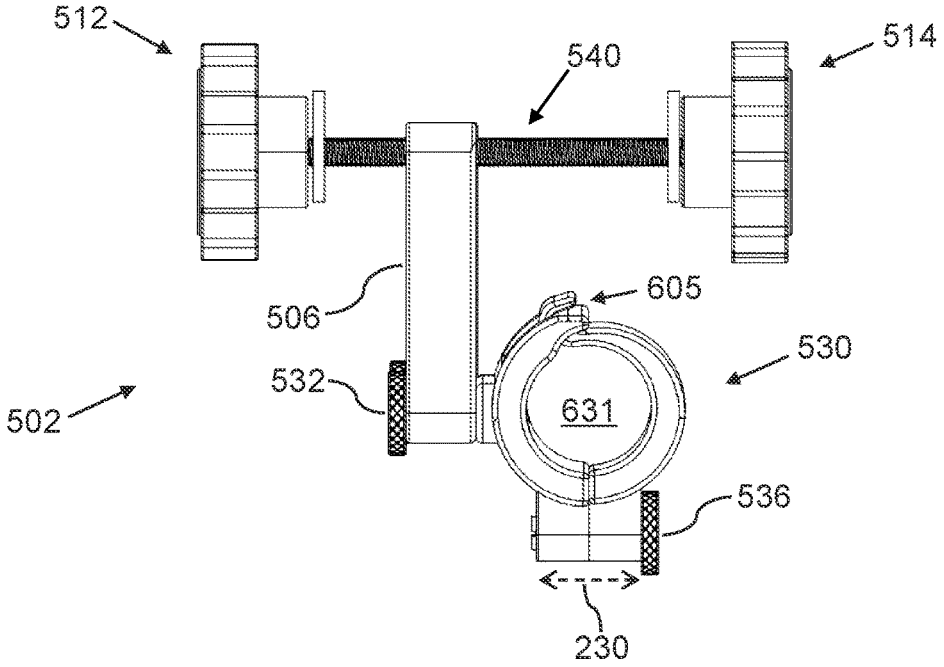
FIG. 6C is a top perspective view of a massage gun mounting device, according to an embodiment of the invention.
Figure 6D:
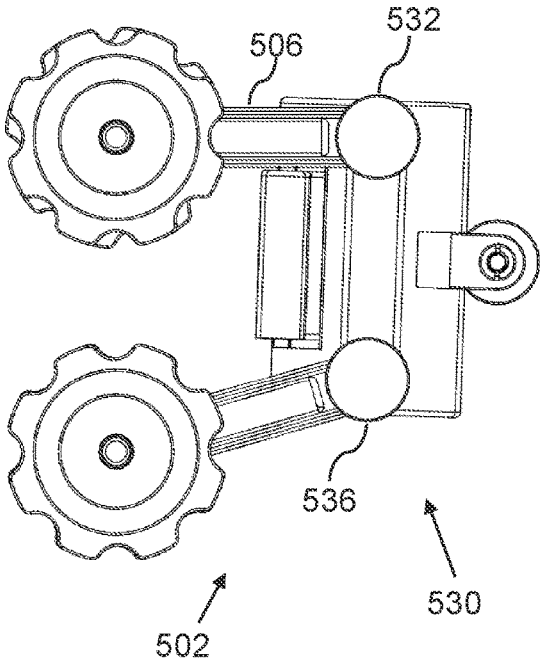
FIG. 6D is a left perspective view of a massage gun mounting device, according to an embodiment of the invention.

In further related embodiment, as shown in FIGS. 6C, 7, and 8, wherein the massage gun holder 530 can include:

a) a hinge 605, as shown in FIG. 6C, which can be mounted between the rear ends of the left holder portion 612 and the right holder portion 614, such that the left holder portion 612 is hingedly connected to the right holder portion 614 along the vertical length of the rear ends of the left holder portion and the right holder portion, wherein the hinge 605 can be configured as a living hinge; or alternatively, the massage gun holder 530 can be configured without the hinge, with specific dimension to hold a set diameter;

wherein the hinge 605, as shown in FIG. 6C, can be comprised of the left holder portion 612 and the right holder portion 614, such that an inner end of the right holder portion 614 interlocks with an inner end of the left holder portion 612, such that the inner end of the right holder portion 614 protrudes through an elongated aperture 810 of an inner end of the left holder portion 612.

wherein an inner end of the right holder portion 614 can include a hook shaped portion 816, such that the hook shaped portion 816 of the right holder portion 614, is configured to be inserted into the elongated aperture 810 of the left holder portion 612, such that the rear ends of the left holder portion 612 and the right holder portion 614 are interlocked, such that the elongated aperture 810 and the hook shaped portion 816 form the hinge 605, whereby the hinge 605 is detachable;

such that the massage gun holder 530 is configured to receive the massage gun device 180.

In another related embodiment, as shown in FIGS. 5, 6A-6E, 7 and 8, the massage gun mounting device 502 can include:

a) an upper holder arm 506, which is an elongated member, such that the upper holder arm 506 can be configured with:

i. an upper inner arm aperture 632, as shown in FIGS. 6A and 7, in an inner end of the upper holder arm 506, such that the upper connector rod 540 protrudes through the upper inner arm aperture 632, such that the inner end of the upper holder arm 506 is slidably 607 and rotatably 609 attached to the upper connector rod 540, as shown in FIGS. 6A and 6B; and ii. an upper outer arm aperture 636, in an outer end of the upper holder arm 506, such that the outer end of the upper holder arm 506 is configured to rotatably attach to the massage gun holder 530 with an upper adjustable arm screw 532 penetrating the massage gun holder 530 and screwing into the upper outer arm aperture 636; and b) a lower holder arm 508, which is an elongated member, such that the lower holder arm 508 can be configured with;

i. a lower inner arm aperture 634, as shown in FIG. 8, in an inner end of the lower holder arm 508, such that the lower connector rod 541 protrudes through the lower inner arm aperture 634, such that the inner end of the lower holder arm 508 is slidably and rotatably attached to the lower connector rod 541; and ii. a lower outer arm aperture 638 in an outer end of the lower holder arm 508, such that the outer end of the lower holder arm 508 is configured to rotatably attach to the massage gun holder 530 with a lower adjustable arm screw 534 penetrating the massage gun holder 530 and screwing into the lower outer arm aperture 638;

such that the upper holder arm 506 and the lower holder arm 508 connect the structure connector 510 to the massage gun holder 530.

In various further related embodiments, the holder arms 506, 508 can facilitate use for a multitude of different applications and be built to accommodate a sliding/bending feature to vary the position or location of the massage gun device 180.

Figure 6E:
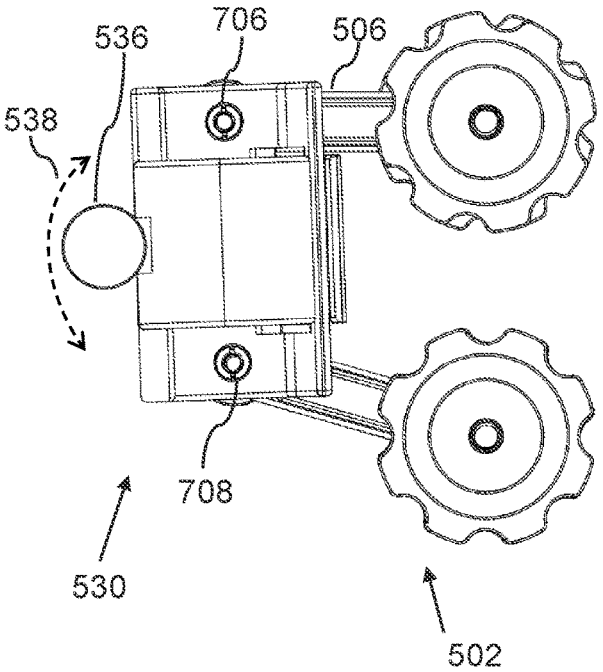
FIG. 6E is a right perspective view of a massage gun mounting device, according to an embodiment of the invention.

In a further related embodiment, as shown in FIGS. 5, 6A-6E, 7, and 8 the massage gun holder 530, can further include:

a) an upper adjustable arm screw 532, which, as shown in FIGS. 6B, 6E, 7, and 8, screws through an upper left holder screw aperture 706 of the of the left holder portion 612;

such that the upper left holder screw aperture 706 can be positioned in a central portion of the left holder portion 612;

such that the upper adjustable arm screw 532 can be configured to screw through the upper left holder screw aperture 706 of the left holder portion 612 of the massage gun device 180 into the outer end of the upper holder arm 506;

b) a lower adjustable arm screw 534, which, as shown in FIGS. 6E and 8, screws through a lower left holder screw aperture 708;

such that the lower left holder screw aperture 708 can be positioned in a central portion of the left holder portion 612;

such that the lower adjustable arm screw 534 can be configured to screw through the lower left holder screw aperture 708 of the left holder portion 612 into the outer end of the lower holder arm 508; and such that tightening of the upper adjustable arm screw 532 and the lower adjustable arm screw 534 locks the massage gun holder 530 in a selected position; and such that loosening of the upper adjustable arm screw 532 and the lower adjustable arm screw 534 enables a pivotable motion 538 of the massage gun holder 530, as shown in FIG. 2G, such that the massage gun holder 530 is pivotable to a selected position; and c) a front adjustable screw 536, which, as shown in FIGS. 6A and 7, screws through a right holder screw aperture 714 of the right holder portion 614 into a left holder screw aperture 712 of the left holder portion 612;

such that the front adjustable screw 536 is configured to screw through outer ends of the right protruding arm member 814, of the right holder portion 614 and the left protruding arm member 812, of the left holder portion 612 of the massage gun holder 530;

such that the right holder screw aperture 714 can be positioned on an outer end of the right protruding arm member 814, of the right holder portion 614;

such that the left holder screw aperture 712 can be positioned on the outer end of the left protruding arm member 812, of the left holder portion 612;

such that a rotation of the front adjustable screw 536 changes a width of a lateral holder gap 230 between front ends of the right holder portion 614 and left holder portion 612;

such that clockwise rotational movements or counter-clockwise rotational movements of the front adjustable screw 536 causes the lateral holder gap 230 to respectively contract or expand.

Figure 9:
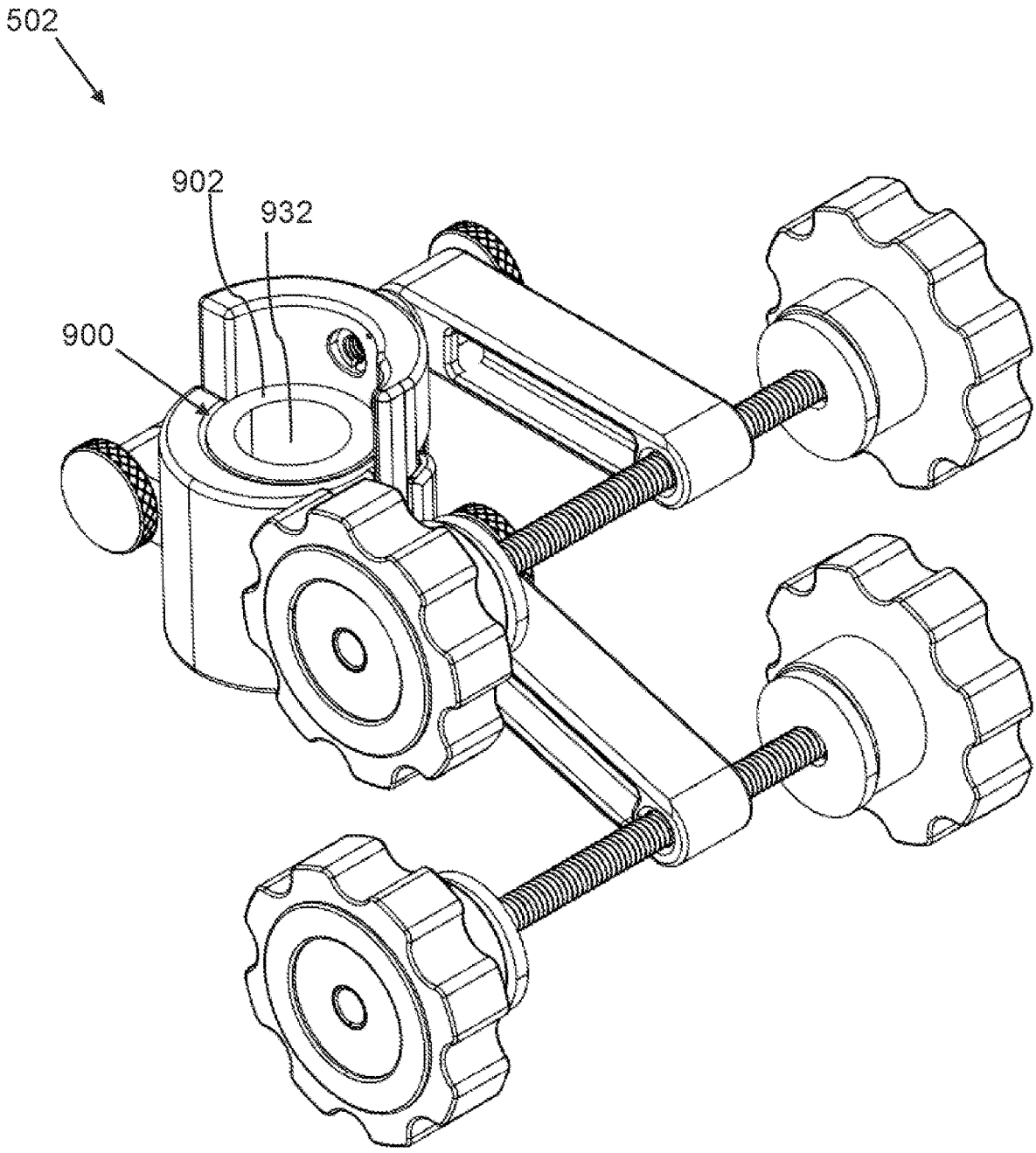
FIG. 9 is a top back right perspective view of a massage gun mounting device, according to an embodiment of the invention.
Figure 10A:
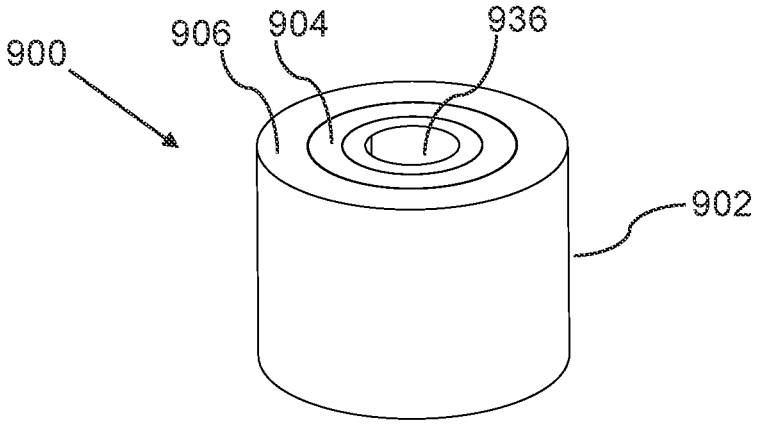
FIG. 10A is a top front perspective view of a massage gun holder insert assembly, according to an embodiment of the invention.
Figure 10B:
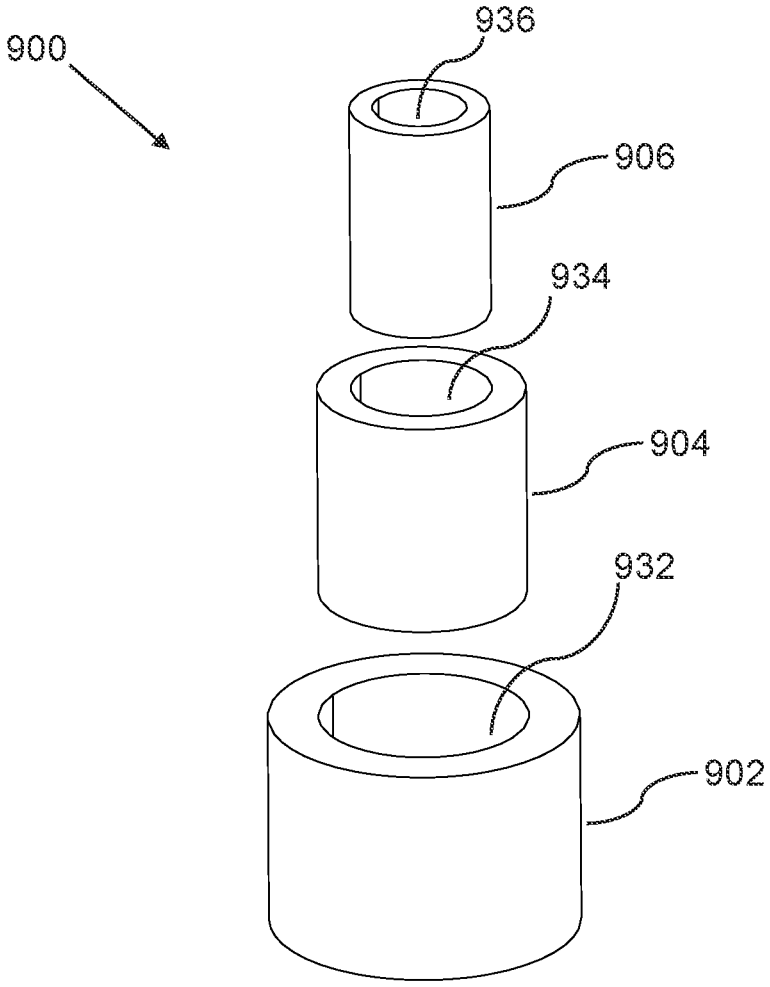
FIG. 10B is a top front exploded part view of a massage gun holder insert assembly, according to an embodiment of the invention.

In a further related embodiment, as shown in FIGS. 9, 10A and 10B, the massage gun holder 530, 130 can further include:

a) a massage gun holder insert assembly 900, which can include a central vertical aperture 932, 934, 936, depending on nested configuration, wherein the massage gun holder assembly 900 can further include:

i. an outer nested insert 902, which can be tubular, and can be made of a resilient and flexible material, such as natural or synthetic rubber;

ii. a middle nested insert 904, which can be tubular, and can be made of a resilient and flexible material, such as natural or synthetic rubber; and iii. an inner nested insert 906, which can be tubular, and can be made of a resilient and flexible material, such as natural or synthetic rubber;

such that the massage gun holder assembly 900 is configured to be positionable in the vertical aperture 231 of the massage gun holder 130, such that the handle member 182 can be insertable into the second vertical aperture 932 of the massage gun holder 130, such that the massage gun holder 930 can be configured to hold the handle member 182 securely;

such that the massage gun holder 130, 530, can include a single nested ring or a combination of an inner nested ring 906, a middle nested ring 904, and an outer nested ring 902, which can be held in place by static friction;

such that the massage gun holder assembly 900, as shown in FIG. 9, can be compressed and held in place through static friction between the massage gun holder assembly 900, the right holder portion 614, and the left holder portion 612, when the lateral holder gap 230 is sufficiently spaced to provide compression on the massage gun holder assembly 900;

such that a smaller handle member 182 of a massage gun device 180 (which may be of a smaller diameter/size than the diameter/size of the massage gun holder 530, without the massage gun holder assembly 900) can be inserted into the massage gun holder assembly 900.

Thus, in a further related embodiment, as shown in FIGS. 9, 10A and 10B, the massage gun holder 530, 130 can further include:

a) a first holder insert 902, which comprises a second vertical aperture 932, wherein the first holder insert 902 is configured to be positionable in the first vertical aperture 631 of the massage gun holder 530, such that the second vertical aperture 932 is configured to receive a second handle member 182 of a second massage gun device 180;

such that the first holder insert 902 can be tubular, as shown, and can be made of a resilient and flexible material, such as natural or synthetic rubber;

whereby the first holder insert 902 permits attachments of a second massage gun device 180 with a second handle member 182 that is thinner than the first handle member 182 of the first massage gun device 180.

In a yet further related embodiment, as shown in FIGS. 9, 10A and 10B, the massage gun holder 530, 130 can further include:

a) a second holder insert 904, which comprises a third vertical aperture 934, wherein the second holder insert 904 is configured to be positionable in the second vertical aperture 932 of the first holder insert, such that the third vertical aperture 934 is configured to receive a third handle member 182 of a third massage gun device 180;

such that the second holder insert 904 can be tubular, as shown, and can be made of a resilient and flexible material, such as natural or synthetic rubber;

whereby the second holder insert 904 permits attachments of a third massage gun device 180 with a third handle member 182 that is thinner than the second handle member 182 of the second massage gun device 180.

In a related embodiment, inner surfaces of the left holder portion 612 and the right holder portion 614 can be concave cylinder segments with curved or beveled edges.

In various further related embodiments, the massage gun holder 530 can facilitate use for a multitude of different applications and be configured alternatively be configured to receive a specified massage gun device 180 dimension and be configured without necessity of the lateral holder gap 230 and adjustability.

In an embodiment of the massage gun mounting device 1102, as shown in FIGS. 11A-11E, 12A-12C, 13A-13C, and 14, the massage gun holder 1130 can include:

a) a left holder portion 1142, wherein the left holder portion 1142 is configured to hold a left side of the handle member of the massage gun device 180; and b) a right holder portion 1144, wherein the right holder portion 1144 is configured to hold a right side of the handle member of the massage gun device 180;

c) left front and rear rubber inserts 1152, 1154, which are configured to mount on inner side of the left holder portion 1142, such that the left front and right rubber inserts 1152, 1154 protects a left side of the handle member of the massage gun device 180;

d) right front and rear rubber inserts 1162, 1164, which are configured to mount on inner side of the left holder portion 1142, such that the left front and right rubber inserts 1162, 1164 protects a right side of the handle member of the massage gun device 180;

e) a front clamping bolt 1172, such that the front clamping bolt 1172 protrudes through a front left aperture 1294 of the left holder portion 1142 and a front right aperture 1394 of the right holder portion 1144;

f) a rear clamping bolt 1174, such that the rear clamping bolt 1174 protrudes through a rear left aperture 1192 of the left holder portion 1142 and a rear right aperture 1392 of the right holder portion 1144;

g) a front clamping nut 1182, such that the front clamping nut 1182 is screwed on to an outer left end of the front clamping bolt 1172; and h) a rear clamping nut 1184, such that the rear clamping nut 1184 is screwed on to an outer left end of the rear clamping bolt 1174;

such that tightening the front clamping nut 1182 and the rear clamping nut 1184 decreases an opening between the left holder portion 1142 and the right holder portion 1144, thereby tightening a grip of the massage gun device 180; and such that loosening the front clamping nut 1182 and the rear clamping nut 1184 allows the massage gun device 180 to be removed from the massage gun holder 1130.

Figure 11A:
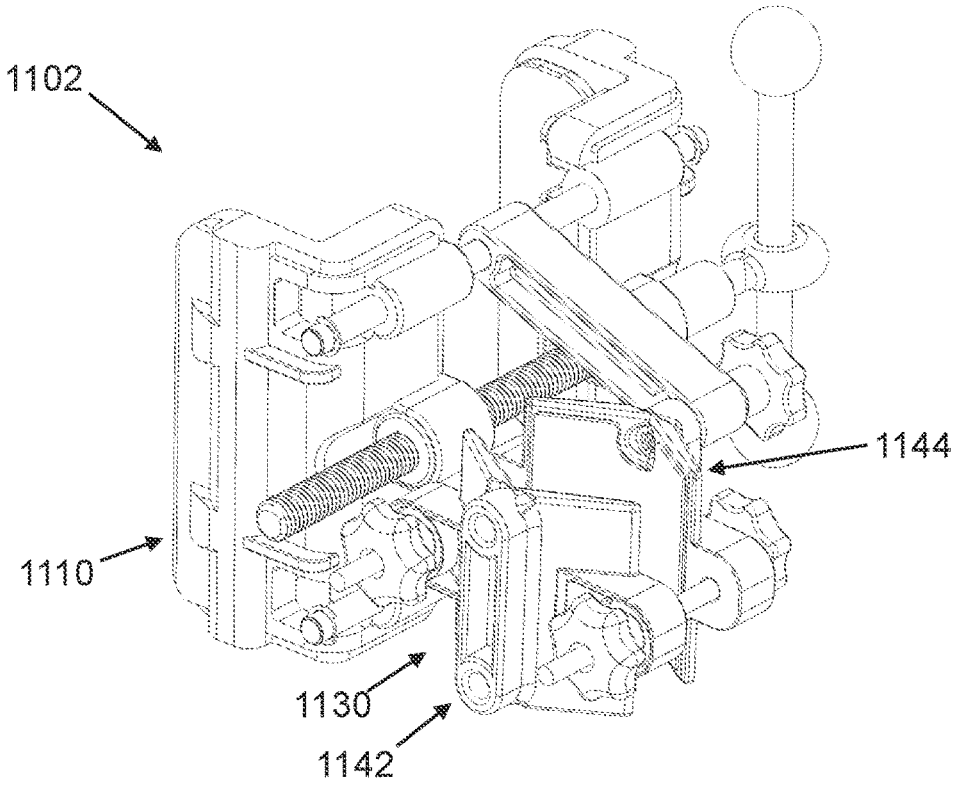
FIG. 11A is a front left perspective view of a massage gun mounting device, according to an embodiment of the invention.
Figure 11B:
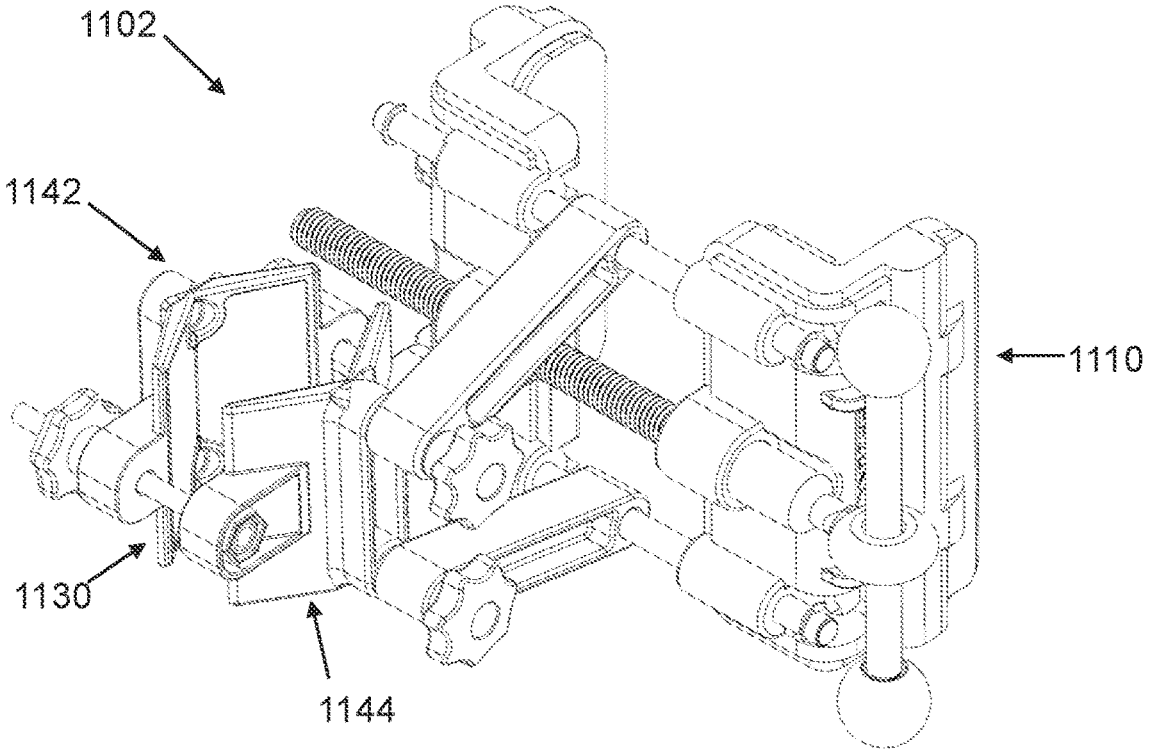
FIG. 11B is a front right perspective view of a massage gun mounting device, according to an embodiment of the invention.
Figure 11C:
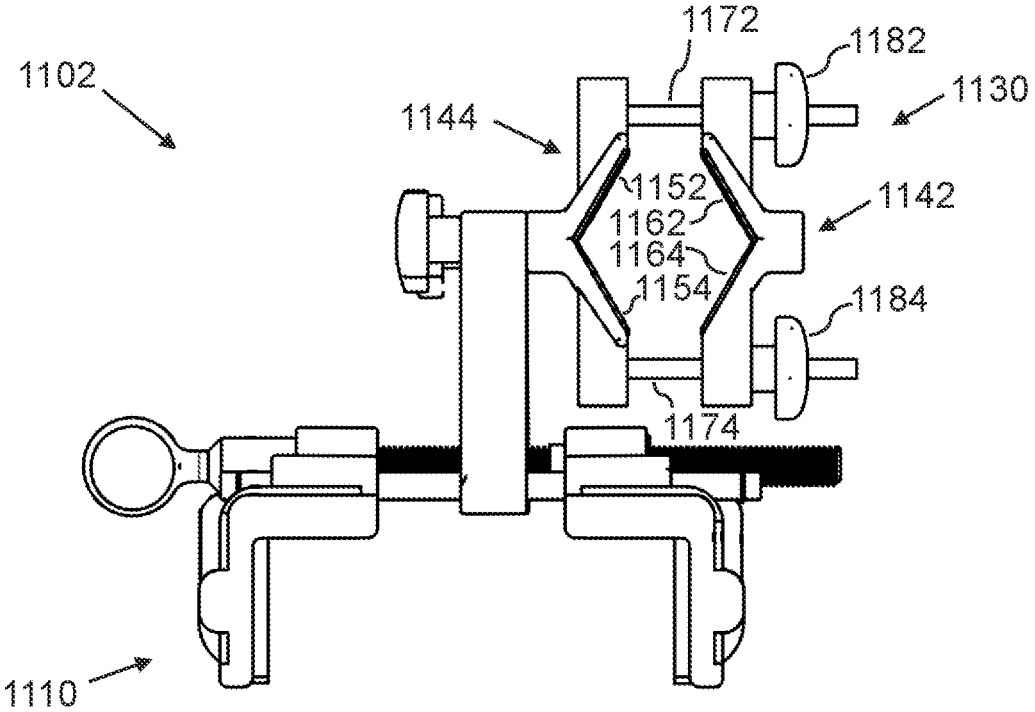
FIG. 11C is a top view of a massage gun mounting device, according to an embodiment of the invention.
Figure 11D:
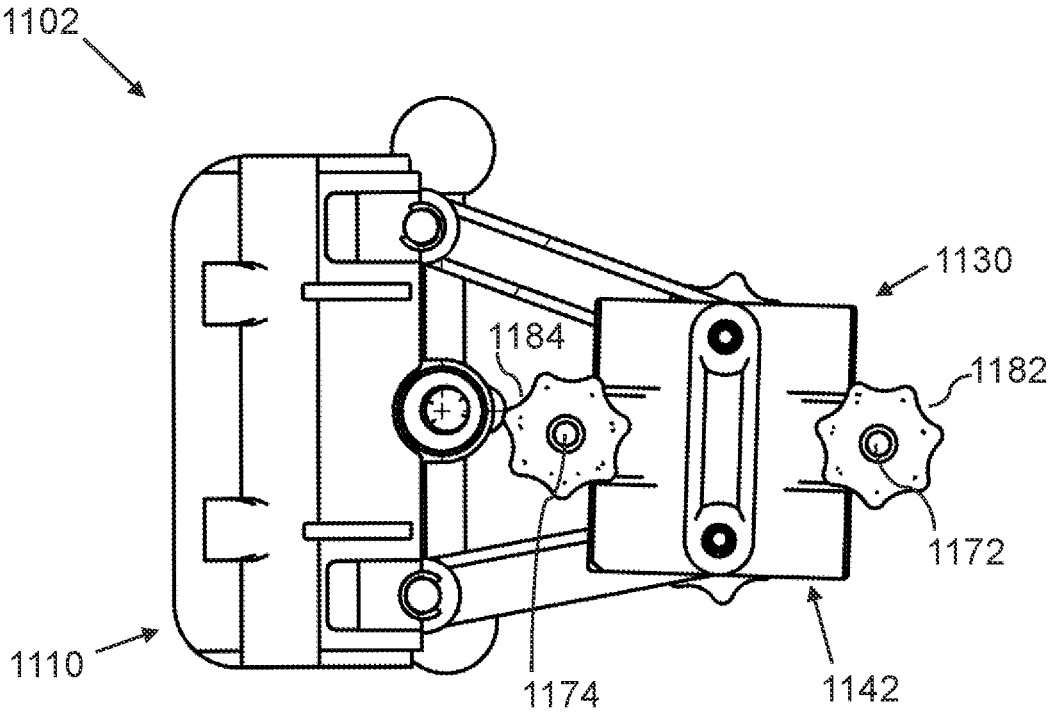
FIG. 11D is a left side view of a massage gun mounting device, according to an embodiment of the invention.
Figure 11E:
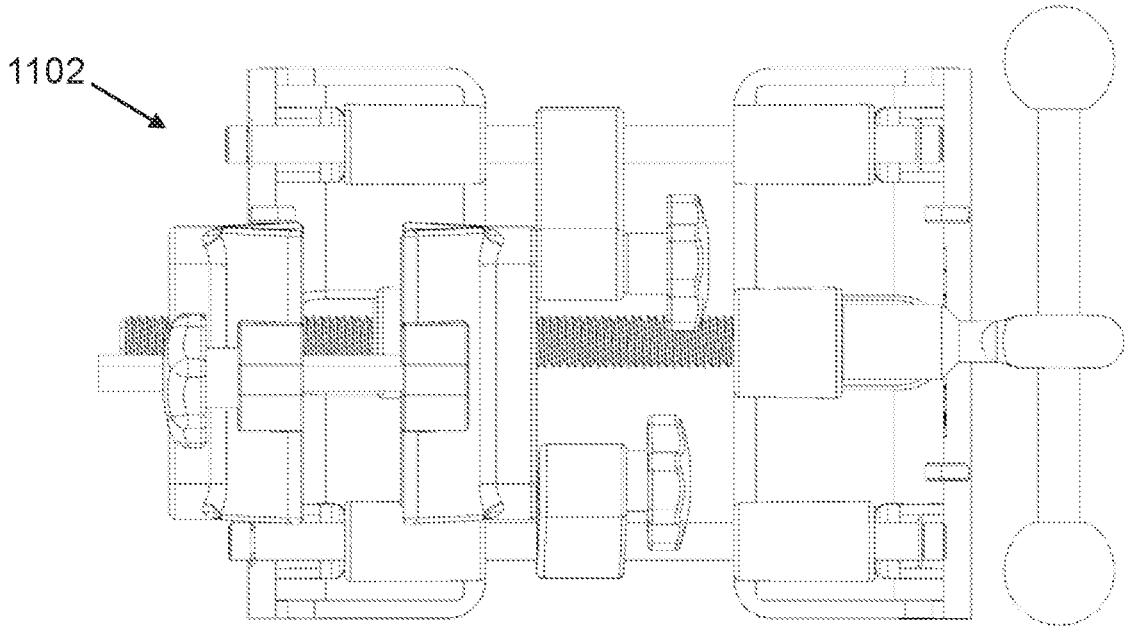
FIG. 11E is a front view of a massage gun mounting device, according to an embodiment of the invention.
Figure 11F:
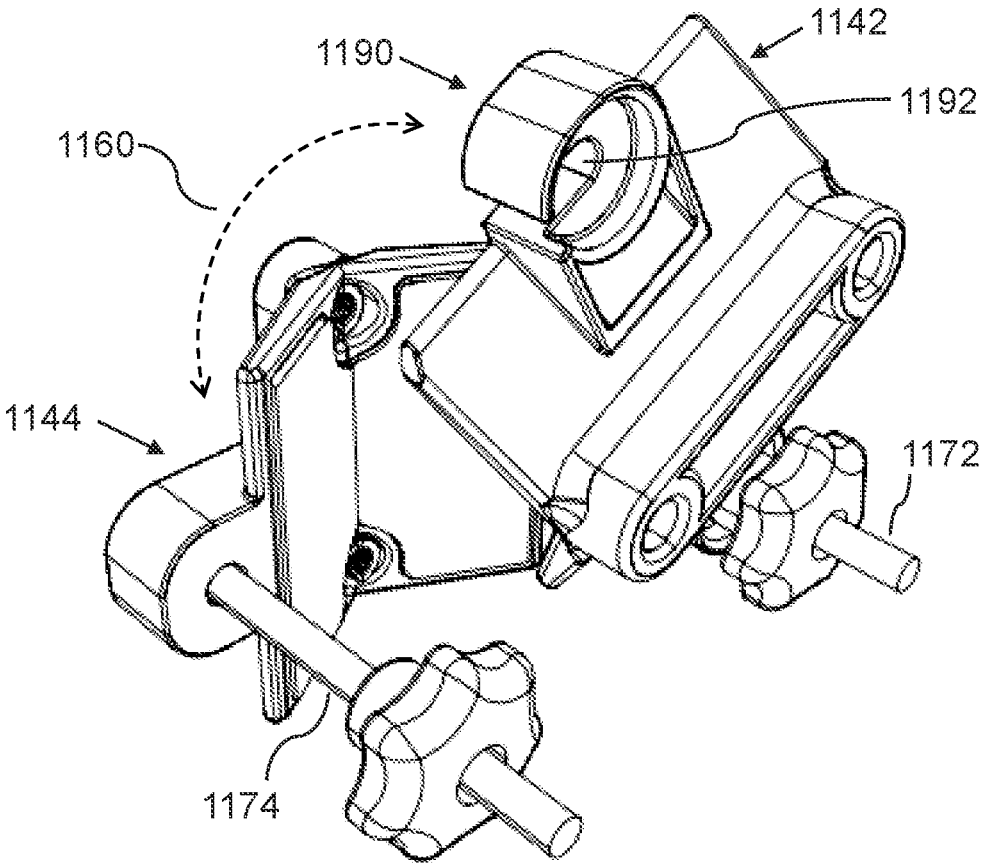
FIG. 11F is a rear left perspective view of left and right holder portions mounted on front and rear clamping bolts, with the left holder portion rotated up, according to an embodiment of the invention.
Figure 12A:
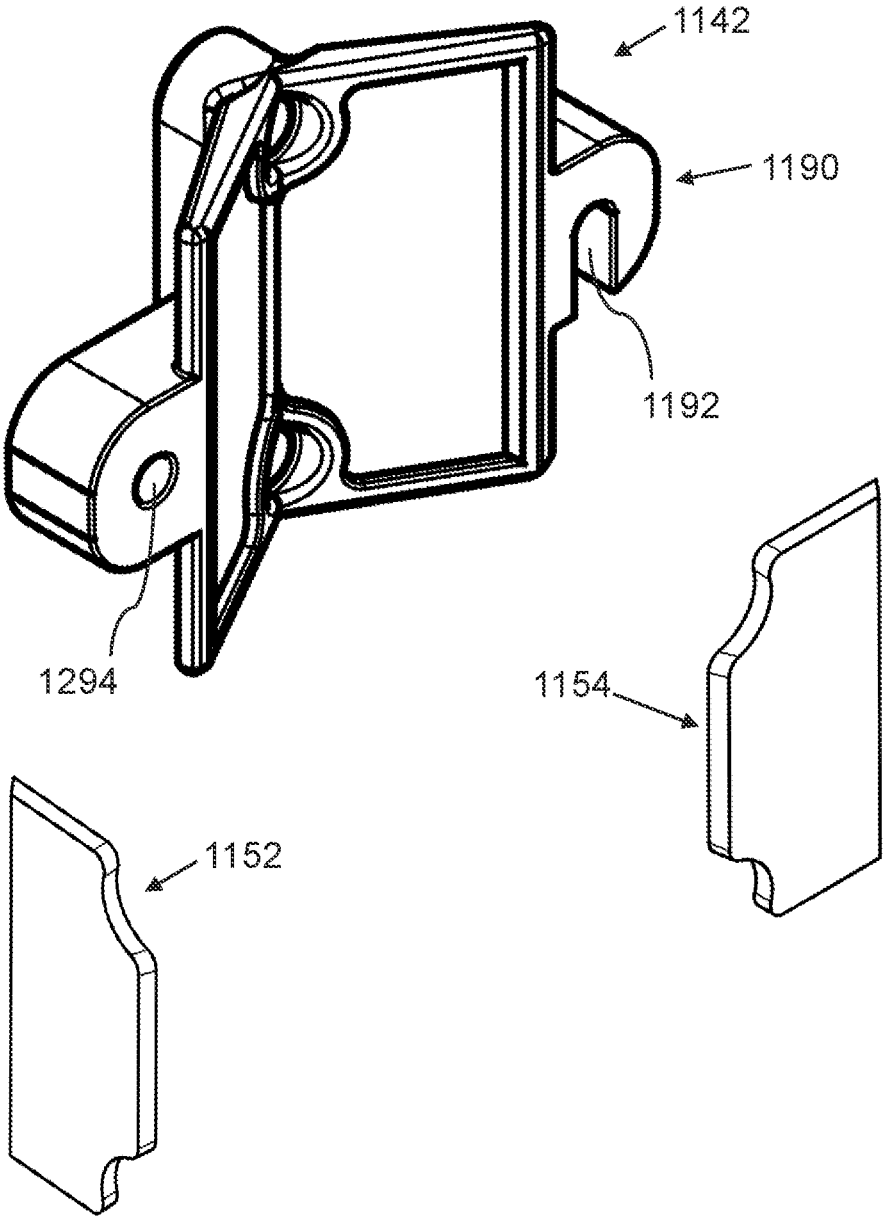
FIG. 12A is an exploded perspective view of a left holder portion with front and rear rubber inserts, according to an embodiment of the invention.
Figure 12B:
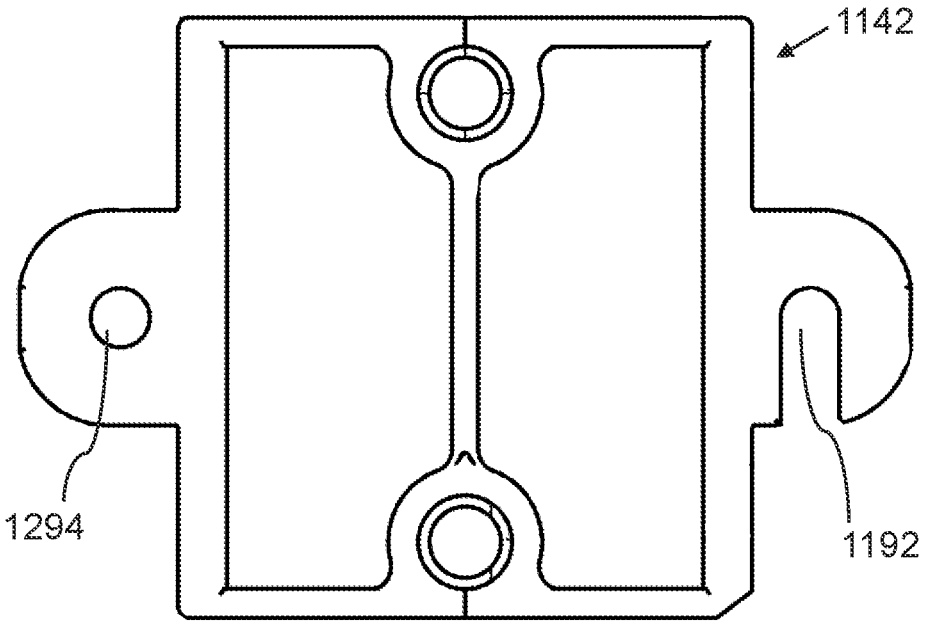
FIG. 12B is an inner side view of a left holder portion, according to an embodiment of the invention.
Figure 12C:
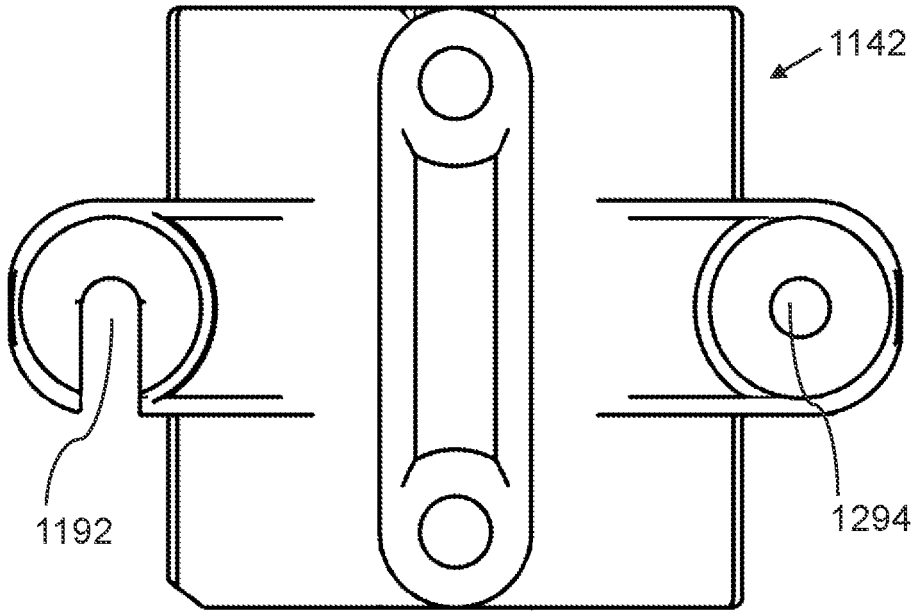
FIG. 12C is an outer side view of a left holder portion, according to an embodiment of the invention.
Figure 13A:
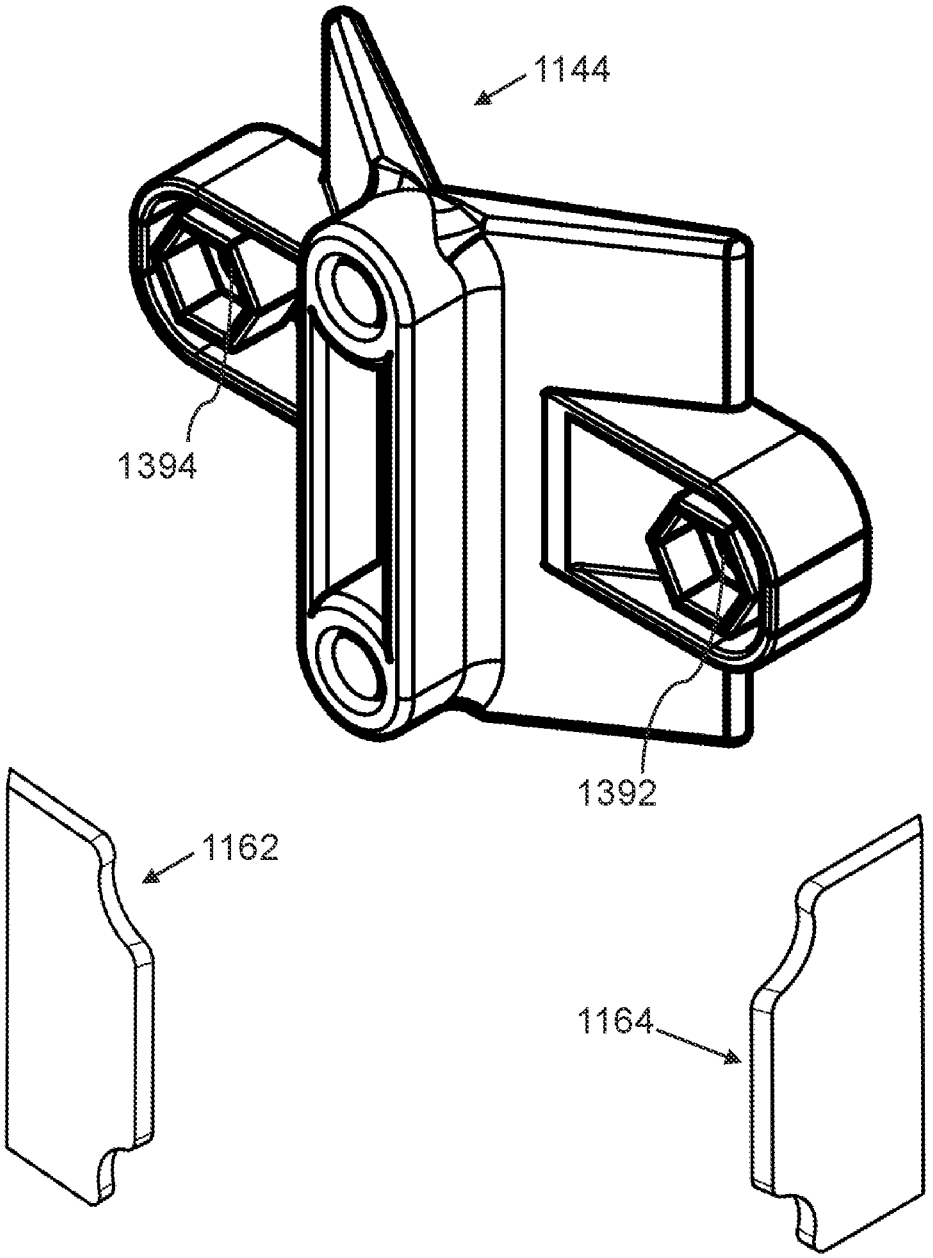
FIG. 13A is an exploded perspective view of a right holder portion with front and rear rubber inserts, according to an embodiment of the invention.
Figure 13B:
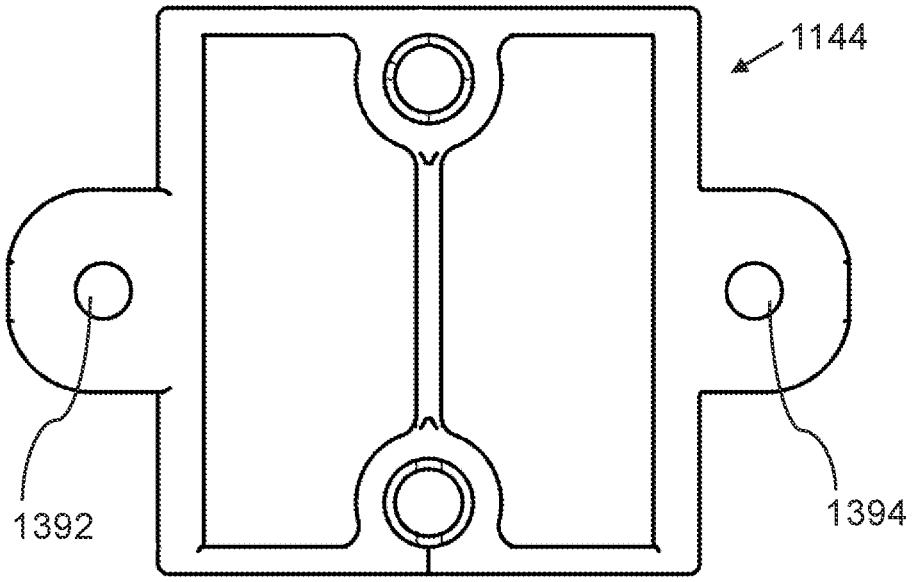
FIG. 13B is an inner side view of a right holder portion, according to an embodiment of the invention.
Figure 13C:
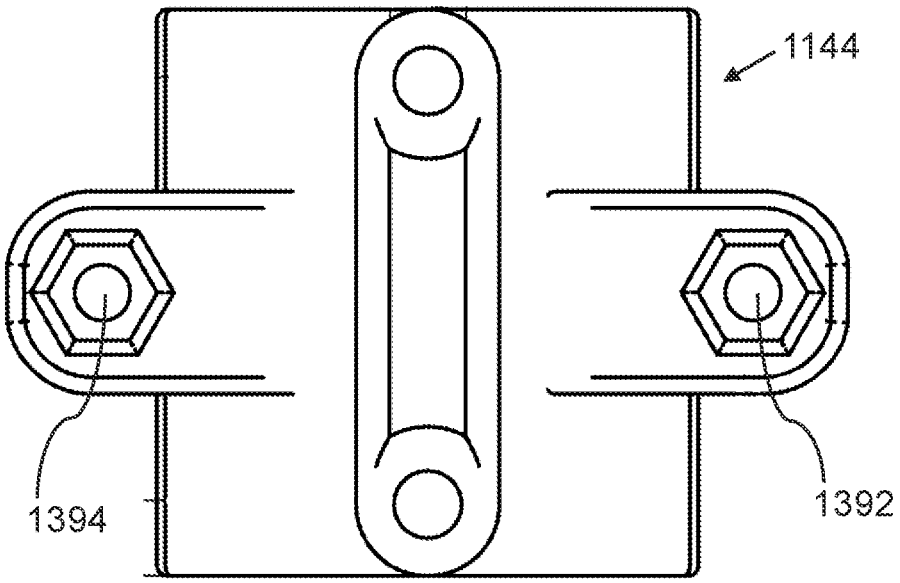
FIG. 13C is an outer side view of a right holder portion, according to an embodiment of the invention.
Figure 14:
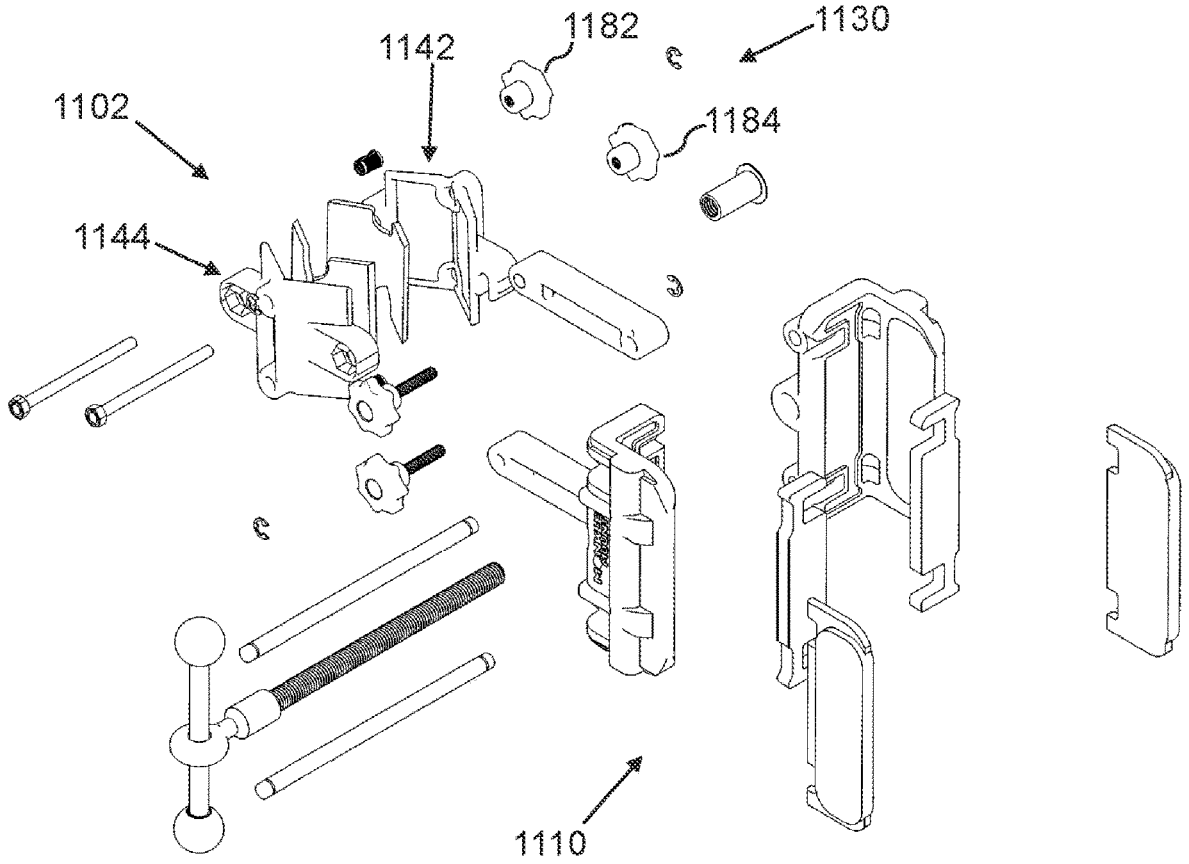
FIG. 14 is an exploded perspective view of the massage gun mounting device shown in FIG. 11A-11E, according to an embodiment of the invention.

In a related embodiment, as shown in FIG. 11F, the left holder portion 1142 can further include (i.e., be configured with):

a) A rear hook portion 1190, which is positioned in a rear end of the left holder portion 1142, wherein the rear hook portion 1190 comprises the rear left aperture 1192, which the rear clamping bolt 1174 is configured to protrude through when the left holder portion 1142 is mounted in place;

such that an outer end of the left holder portion 1142 is configured to be pivotable 1160 around the front clamping bolt 1172, such that the left holder portion 1142 can be rotated (is rotatable) up, as shown in FIG. 11F, to provide improved access to insert a handle member 182 of a massage gun device 180, such that the rear hook portion 1190 can be rotated (is rotatable) back onto the rear clamping bolt 1174, once the handle member 182 of the massage gun device 180 is inserted in position.

Here has thus been described a multitude of embodiments of the massage gun mounting system 100, 500, the massage gun mounting device 102, 502, 1102, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A massage gun mounting system, comprising:

a) a massage gun mounting device, comprising:

a structure connector, wherein the structure connector further comprises:

a left clamp portion;

a right clamp portion, which is connected to the left clamp portion;

an upper connector rod, which is connected between the left clamp portion and the right clamp portion;

such that a left portion of the upper connector rod is laterally slidably connected to the left clamp portion, such that the left portion of the upper connector rod protrudes through the left clamp portion; and such that a right portion of the upper connector rod is laterally slidably connected to the right clamp portion, such that the right portion of the upper connector rod protrudes through the right clamp portion; and a lower connector rod, which is connected between the left clamp portion and the right clamp portion, such that the lower connector rod is mounted below the upper connector rod;

such that a left portion of the lower connector rod is laterally slidably connected to the left clamp portion, such that the left portion of the lower connector rod protrudes through the left clamp portion; and such that a right portion of the lower connector rod is connected to the right clamp portion, such that the right portion of the lower connector rod protrudes through the right clamp portion;

whereby the upper connector rod and the lower connector rod stabilize the structure connector and enable adjustable connection of the structure connector to a mounting structure;

wherein the structure connector is configured to enable adjustment of a lateral gap between the left clamp portion and the right clamp portion, to match a thickness of the mounting structure; and a massage gun holder, which is connected to the structure connector; and b) a massage gun device, comprising a handle member; and a massage delivery member;

wherein the structure connector is configured to securely and detachably attach the massage gun mounting device to the mounting structure; and wherein the massage gun holder is configured to receive the handle member of the massage gun device, such that the handle member is insertable into the massage gun holder, such that the massage gun holder is configured to hold the handle member securely, whereby the massage gun mounting device holds the massage gun device securely;

whereby the massage gun device is stably and safely positionable in a convenient position on the mounting structure, such that a user is enabled to apply pressure to a body area of the user with the massage delivery member of the massage gun device.

2. The massage gun mounting system of claim 1, wherein the structure connector further comprises:

a) a left protective pad, which is mounted on an inner side of the left clamp portion, such that the left protective pad protrudes from the left clamp portion; and b) a right protective pad, which is mounted on an inner side of the right clamp portion, such that the right protective pad protrudes from the right clamp portion.

3. The massage gun mounting system of claim 2, wherein:

a) the inner side of the left clamp portion further comprises:

a left pad receiving indentation, which is configured to receive the left protective pad, such that an inner portion of the left protective pad is inserted into the left pad receiving indentation; and b) the inner side of the right clamp portion further comprises:

a right pad receiving indentation, which is configured to receive the right protective pad, such that an inner portion of the right protective pad is inserted into the right pad receiving indentation.

4. The massage gun mounting system of claim 2, wherein the left protective pad and the right protective pad are made from a resilient material.

5. The massage gun mounting system of claim 4, wherein the resilient material is a rubber material.

6. The massage gun mounting system of claim 1, wherein the structure connector further comprises:

an adjustment rod;

wherein the adjustment rod is rotatably connected between the left clamp portion and the right clamp portion, such that the adjustment rod protrudes through the left clamp portion and the right clamp portion;

wherein the adjustment rod is configured such that a rotation of the adjustment rod is configured to adjust the lateral gap, such that the lateral gap is adjustable to match the thickness of the mounting structure.

7. The massage gun mounting system of claim 6, wherein the adjustment rod further comprises:

a threaded shaft;

wherein the left clamp portion further comprises:

a left clamp aperture, which comprises an internal threading;

wherein the structure connector further comprises:

a rod stopper, which is connected to a right outer end of the adjustment rod, such that the rod stopper is configured to hold the adjustment rod in position, to prevent a leftward movement of the adjustment rod;

such that the adjustment rod screws through the left clamp aperture, such that the adjustment rod rotatably protrudes through the left clamp aperture;

such that a first direction rotation of the adjustment rod causes the left clamp portion to be pulled inward, thereby reducing the lateral gap between the left clamp portion and the right clamp portion.

8. The massage gun mounting system of claim 6, wherein the structure connector further comprises:

a movement lever, which is slidably and perpendicularly connected to the adjustment rod, such that the movement lever facilitates the rotation of the adjustment rod.

9. The massage gun mounting system of claim 1, wherein the massage gun holder further comprises:

a) a left holder portion, which is configured to hold a left side of the handle member of the massage gun device; and b) a right holder portion, which is configured to hold a right side of the handle member of the massage gun device;

wherein the left holder portion is flexibly connected to the right holder portion along a vertical length of rear ends of the left holder portion and the right holder portion.

10. The massage gun mounting system of claim 9, wherein the massage gun holder further comprises:

a hinge, which is mounted between the rear ends of the left holder portion and the right holder portion, such that the left holder portion is hingedly connected to the right holder portion along the vertical length of the rear ends of the left holder portion and the right holder portion.

11. The massage gun mounting system of claim 10, wherein the left holder portion further comprises an elongated aperture in an inner end of the left holder portion; and;

wherein an inner end of the right holder portion comprises a hook shaped portion, such that the hook shaped portion of the right holder portion, is configured to be inserted into the elongated aperture of the left holder portion, such that the rear ends of the left holder portion and the right holder portion are interlocked, such that the elongated aperture and the hook shaped portion form the hinge, whereby the hinge is detachable.

12. The massage gun mounting system of claim 9, wherein inner surfaces of the left holder portion and the right holder portion are concave cylinder segments.

13. The massage gun mounting system of claim 9, further comprising:

a) an upper holder arm, which is an elongated member, which further comprises:

an upper inner arm aperture in an inner end of the upper holder arm, such that the upper connector rod protrudes through the upper inner arm aperture, such that the inner end of the upper holder arm is slidably and rotatably attached to the upper connector rod, such that an outer end of the upper holder arm is rotatably connected to the massage gun holder; and b) a lower holder arm, which is an elongated member, which further comprises: a lower inner arm aperture, in an inner end of the lower holder arm, such that the lower connector rod protrudes through the lower inner arm aperture, such that the inner end of the lower holder arm is slidably and rotatably attached to the lower connector rod, such that an outer end of the lower holder arm is rotatably connected to the massage gun holder;

such that the upper holder arm and the lower holder arm connect the structure connector to the massage gun holder.

14. The massage gun mounting system of claim 13, wherein the massage gun holder further comprises:

a) an upper adjustable arm screw, which is configured to screw through the left holder portion of the massage gun holder into the outer end of the upper holder arm; and b) a lower adjustable arm screw, which is configured to screw through the left holder portion of the massage gun holder into the outer end of the lower holder arm;

such that tightening of the upper adjustable arm screw and the lower adjustable arm screw locks the massage gun holder in a selected position; and such that loosening of the upper adjustable arm screw and the lower adjustable arm screw enables a pivotable motion of the massage gun holder, such that the massage gun holder is pivotable to the selected position.

15. The massage gun mounting system of claim 9, wherein the massage gun holder further comprises:

a front adjustable screw, which is configured to screw through outer ends of the right holder portion and the left holder portion of the massage gun holder;

such that a rotation of the front adjustable screw changes a width of a lateral holder gap between front ends of the right holder portion and the left holder portion;

such that clockwise rotational movements or counterclockwise rotational movements of the front adjustable screw causes the lateral holder gap to respectively contract or expand.

16. A massage gun mounting system, comprising:

a massage gun mounting device, comprising:

a structure connector; and a massage gun holder, which is connected to the structure connector, wherein the massage gun holder comprises a first vertical aperture, wherein the massage gun holder further comprises:

a left holder portion, which is configured to hold a left side of a handle member of a massage gun device; and a right holder portion, which is configured to hold a right side of the handle member of the massage gun device, wherein the left holder portion is flexibly connected to the right holder portion along a vertical length of rear ends of the left holder portion and the right holder portion;

a front clamping bolt, such that the front clamping bolt protrudes through a front left aperture of the left holder portion and a front right aperture of the right holder portion;

a rear clamping bolt, such that the rear clamping bolt protrudes through a rear left aperture of the left holder portion and a rear right aperture of the right holder portion;

a front clamping nut, such that the front clamping nut is screwed on to an outer end of the front clamping bolt; and a rear clamping nut, such that the rear clamping nut is screwed on to an outer end of the rear clamping bolt;

such that tightening the front clamping nut and the rear clamping nut decreases an opening between the left holder portion and the right holder portion, thereby tightening a grip of the massage gun device; and such that loosening the front clamping nut and the rear clamping nut allows the massage gun device to be removed from the massage gun holder;

wherein the left holder portion further comprises:

a rear hook portion, which is positioned in a rear end of the left holder portion, wherein the rear hook portion comprises the rear left aperture, which the rear clamping bolt is configured to protrude through when the left holder portion is mounted in place;

such that an outer end of the left holder portion is configured to be pivotable around the front clamping bolt, such that the left holder portion is rotatable up, to provide improved access to insert the handle member of the massage gun device, such that the rear hook portion is rotatable back onto the rear clamping bolt, once the handle member of the massage gun device is inserted in position;

wherein the structure connector is configured to securely and detachably attach the massage gun mounting device to a mounting structure; and wherein the massage gun holder is configured to receive the handle member of the massage gun device, such that the handle member is insertable into the massage gun holder, such that the massage gun holder is configured to hold the handle member securely, whereby the massage gun mounting device holds the massage gun device securely;

whereby the massage gun device is stably and safely positionable in a convenient position on the mounting structure, such that a user is enabled to apply pressure to a body area of the user with a massage delivery member of the massage gun device.

17. The massage gun mounting system of claim 16, wherein the structure connector further comprises:

a) a left clamp portion; and b) a right clamp portion, which is connected to the left clamp portion;

wherein the structure connector is configured to enable adjustment of a lateral gap between the left clamp portion and the right clamp portion, to match a thickness of the mounting structure.

18. The massage gun mounting system of claim 17, wherein the structure connector further comprises:

an adjustment rod;

wherein the adjustment rod is rotatably connected between the left clamp portion and the right clamp portion, such that the adjustment rod protrudes through the left clamp portion and the right clamp portion;

wherein the adjustment rod is configured such that a rotation of the adjustment rod is configured to adjust the lateral gap, such that the lateral gap is adjustable to match the thickness of the mounting structure.

19. The massage gun mounting system of claim 17, wherein the structure connector further comprises:

a) an upper connector rod, which is connected between the left clamp portion and the right clamp portion;

such that a left portion of the upper connector rod is laterally slidably connected to the left clamp portion, such that the left portion of the upper connector rod protrudes through the left clamp portion; and such that a right portion of the upper connector rod is laterally slidably connected to the right clamp portion, such that the right portion of the upper connector rod protrudes through the right clamp portion; and b) a lower connector rod, which is connected between the left clamp portion and the right clamp portion, such that the lower connector rod is mounted below the upper connector rod;

such that a left portion of the lower connector rod is laterally slidably connected to the left clamp portion, such that the left portion of the lower connector rod protrudes through the left clamp portion; and such that a right portion of the lower connector rod is connected to the right clamp portion, such that the right portion of the lower connector rod protrudes through the right clamp portion;

whereby the upper connector rod and the lower connector rod stabilize the structure connector and enable adjustable connection of the structure connector to the mounting structure.

20. The massage gun mounting system of claim 19, further comprising:

a) an upper holder arm, which is an elongated member, further comprising:

an upper inner arm aperture in an inner end of the upper holder arm, such that the upper connector rod protrudes through the upper inner arm aperture, such that the inner end of the upper holder arm is slidably and rotatably attached to the upper connector rod, such that an outer end of the upper holder arm is rotatably connected to the massage gun holder; and b) a lower holder arm, which is an elongated member, further comprising:

a lower inner arm aperture, in an inner end of the lower holder arm, such that the lower connector rod protrudes through the lower inner arm aperture, such that the inner end of the lower holder arm is slidably and rotatably attached to the lower connector rod, such that an outer end of the lower holder arm is rotatably connected to the massage gun holder;

such that the upper holder arm and the lower holder arm connect the structure connector to the massage gun holder.

21. The massage gun mounting system of claim 20, wherein the massage gun holder further comprises:

a) an upper adjustable arm screw, which is configured to screw through the left holder portion of the massage gun holder into the outer end of the upper holder arm; and b) a lower adjustable arm screw, which is configured to screw through the left holder portion of the massage gun holder into the outer end of the lower holder arm;

such that tightening of the upper adjustable arm screw and the lower adjustable arm screw locks the massage gun holder in a selected position; and such that loosening of the upper adjustable arm screw and the lower adjustable arm screw enables a pivotable motion of the massage gun holder, such that the massage gun holder is pivotable to the selected position.

22. The massage gun mounting system of claim 19, wherein the massage gun holder further comprises:

a front adjustable screw, which is configured to screw through outer ends of the right holder portion and the left holder portion of the massage gun holder;

such that a rotation of the front adjustable screw changes a width of a lateral holder gap between front ends of the right holder portion and the left holder portion;

such that clockwise rotational movements or counterclockwise rotational movements of the front adjustable screw causes the lateral holder gap to respectively contract or expand.

23. The massage gun mounting system of claim 16, further comprising:

an upper holder arm, which is configured with an upper inner arm aperture in an inner end of the upper holder arm;

wherein the structure connector further comprises:

an upper connector assembly, which comprises:

an upper connector rod;

such that the upper connector rod protrudes through the upper inner arm aperture, such that the inner end of the upper holder arm is attached to the upper connector rod;

such that the upper connector rod is configured to protrude through an upper connection aperture of the mounting structure, such that the upper connector assembly is connected to the mounting structure;

such that an outer end of the upper holder arm is connected to the massage gun holder;

such that the upper holder arm connects the structure connector to the massage gun holder.

24. The massage gun mounting system of claim 23, further comprising:

a lower holder arm, which is configured with a lower inner arm aperture in an inner end of the lower holder arm;

wherein the structure connector further comprises:

a lower connector assembly, comprising:

a lower connector rod;

such that the lower connector rod protrudes through the lower inner arm aperture, such that the inner end of the lower holder arm is attached to the lower connector rod;

such that the lower connector rod is configured to protrude through a lower connection aperture of the mounting structure, such that the lower connector assembly is connected to the mounting structure;

such that an outer end of the lower holder arm is connected to the massage gun holder;

such that the lower holder arm connects the structure connector to the massage gun holder.

25. The massage gun mounting system of claim 24, wherein the structure connector further comprises:

a left upper fastener, which is configured to screw onto a left end of the upper connector rod;

a right upper fastener, which is configured to screw onto a right end of the upper connector rod;

a left lower fastener, which is configured to screw onto a left end of the lower connector rod; and a right lower fastener, which is configured to screw onto a right end of the lower connector rod;

such that the left upper fastener and the right upper fastener are configured to tighten the upper connector rod in place on the mounting structure, with the upper connector rod protruding through the upper connection aperture of the mounting structure, and the upper holder arm connected to the upper connector rod, between the left upper fastener and the right upper fastener, which are fastened onto the left end and the right end of the upper connector rod, respectively; and such that the left lower fastener and the right lower fastener are configured to tighten the lower connector rod in place on the mounting structure, with the lower connector rod protruding through the lower connection aperture of the mounting structure, and the lower holder arm connected to the lower connector rod, between the left lower fastener and the right lower fastener, which are fastened onto the left end and the right end of the lower connector rod, respectively.

26. The massage gun mounting system of claim 16, further comprising:

a first holder insert, which comprises a second vertical aperture, wherein the first holder insert is configured to be positionable in the first vertical aperture of the massage gun holder, such that the second vertical aperture is configured to receive a second handle member of a second massage gun device.

27. The massage gun mounting system of claim 26, further comprising:

a second holder insert, which comprises a third vertical aperture, wherein the second holder insert is configured to be positionable in the second vertical aperture of the first holder insert, such that the third vertical aperture is configured to receive a third handle member of a third massage gun device.

28. A massage gun mounting system, comprising:

a massage gun mounting device, comprising:

a structure connector, wherein the structure connector further comprises:

a left clamp portion;

a right clamp portion, which is connected to the left clamp portion;

an upper connector rod, which is connected between the left clamp portion and the right clamp portion;

such that a left portion of the upper connector rod is laterally slidably connected to the left clamp portion, such that the left portion of the upper connector rod protrudes through the left clamp portion; and such that a right portion of the upper connector rod is laterally slidably connected to the right clamp portion, such that the right portion of the upper connector rod protrudes through the right clamp portion; and a lower connector rod, which is connected between the left clamp portion and the right clamp portion, such that the lower connector rod is mounted below the upper connector rod;

such that a left portion of the lower connector rod is laterally slidably connected to the left clamp portion, such that the left portion of the lower connector rod protrudes through the left clamp portion; and such that a right portion of the lower connector rod is connected to the right clamp portion, such that the right portion of the lower connector rod protrudes through the right clamp portion;

whereby the upper connector rod and the lower connector rod stabilize the structure connector and enable adjustable connection of the structure connector to a mounting structure;

wherein the structure connector is configured to enable adjustment of a lateral gap between the left clamp portion and the right clamp portion, to match a thickness of the mounting structure; and a massage gun holder, which is connected to the structure connector, wherein the massage gun holder comprises a first vertical aperture;

wherein the structure connector is configured to securely and detachably attach the massage gun mounting device to the mounting structure; and wherein the massage gun holder is configured to receive a handle member of a massage gun device, such that the handle member is insertable into the massage gun holder, such that the massage gun holder is configured to hold the handle member securely, whereby the massage gun mounting device holds the massage gun device securely;

whereby the massage gun device is stably and safely positionable in a convenient position on the mounting structure, such that a user is enabled to apply pressure to a body area of the user with a massage delivery member of the massage gun device.

29. A massage gun mounting system, comprising:

a massage gun mounting device, comprising:

a structure connector, further comprising:

an upper connector assembly, which comprises:

an upper connector rod;

a massage gun holder, which is connected to the structure connector, wherein the massage gun holder comprises a first vertical aperture; and an upper holder arm, which is configured with an upper inner arm aperture in an inner end of the upper holder arm;

such that the upper connector rod protrudes through the upper inner arm aperture, such that the inner end of the upper holder arm is attached to the upper connector rod;

such that the upper connector rod is configured to protrude through an upper connection aperture of a mounting structure, such that the upper connector assembly is connected to the mounting structure;

such that an outer end of the upper holder arm is connected to the massage gun holder;

such that the upper holder arm connects the structure connector to the massage gun holder;

wherein the structure connector is configured to securely and detachably attach the massage gun mounting device to the mounting structure; and wherein the massage gun holder is configured to receive a handle member of a massage gun device, such that the handle member is insertable into the massage gun holder, such that the massage gun holder is configured to hold the handle member securely, whereby the massage gun mounting device holds the massage gun device securely;

whereby the massage gun device is stably and safely positionable in a convenient position on the mounting structure, such that a user is enabled to apply pressure to a body area of the user with a massage delivery member of the massage gun device.

* * * * *